US010000309B2

(12) United States Patent
Carmichael et al.

(10) Patent No.: US 10,000,309 B2
(45) Date of Patent: Jun. 19, 2018

(54) LABELLING MACHINE AND METHOD

(71) Applicant: Sidel S.p.A., Parma (IT)

(72) Inventors: James Carmichael, Parma (IT); Marco Ferri, Parma (IT); Nicola Veneziani, Parma (IT)

(73) Assignee: SIDEL S.P.A., Parma (IT)

( * ) Notice: Subject to any disclaimer, the term of this patent is extended or adjusted under 35 U.S.C. 154(b) by 377 days.

(21) Appl. No.: 14/659,643

(22) Filed: Mar. 17, 2015

(65) Prior Publication Data

US 2015/0274348 A1 Oct. 1, 2015

(30) Foreign Application Priority Data

Mar. 31, 2014 (EP) ..... 14162536

(51) Int. Cl.

| | |
|---|---|
| ***B65C 9/08*** | (2006.01) |
| ***B65C 9/42*** | (2006.01) |
| ***B65C 9/02*** | (2006.01) |
| ***B65C 9/18*** | (2006.01) |
| ***B65C 9/30*** | (2006.01) |
| ***B65C 9/40*** | (2006.01) |

(52) U.S. Cl.

CPC ..... *B65C 9/42* (2013.01); *B65C 9/02* (2013.01); *B65C 9/183* (2013.01); *B65C 9/1819* (2013.01); *B65C 9/30* (2013.01); *B65C 9/40* (2013.01); *Y10T 156/10* (2015.01); *Y10T 156/1033* (2015.01); *Y10T 156/1744* (2015.01); *Y10T 156/1773* (2015.01)

(58) Field of Classification Search

CPC .... B65C 3/06; B65C 3/08; B65C 3/14; B65C 3/16; B65C 3/163; B65C 3/26; B65C 9/00; B65C 9/18; B65C 9/1815; B65C 9/1819; B65C 9/1826; B65C 9/1876; B65C 9/188; B65C 9/1884; Y10T 156/1028; Y10T 156/103; Y10T 156/1033; Y10T 156/1744; Y10T 156/1768; Y10T 156/1771; Y10T 156/1773

USPC ..... 156/DIG. 8, DIG. 9, DIG. 13, 363, 364

See application file for complete search history.

(56) References Cited

FOREIGN PATENT DOCUMENTS

EP 2832652 A1 2/2015

*Primary Examiner* — Carson Gross

(74) *Attorney, Agent, or Firm* — Finnegan, Henderson, Farabow, Garrett & Dunner LLP

(57) ABSTRACT

A labelling group for applying at least one label onto a respective article at an application station is disclosed. The labelling group comprises a transfer element, which is adapted to transfer the label along a trajectory which comprises a transfer station, and can be arranged in an operative position, in which the transfer station coincides, in use, with the application station; and a diverting device, which can be selectively arranged in: a first configuration, which allows the transfer element to convey the label along at least part of the trajectory and to release the label at the transfer station; or in a second configuration, which prevents the transfer element either from receiving the label or from releasing the label to the transfer station. The transfer element is movable in at least one rest position, in which the trajectory is spaced from the application station.

13 Claims, 21 Drawing Sheets

LABELLING MACHINE AND METHOD

CROSS-REFERENCE TO RELATED APPLICATIONS

This application claims the benefit of priority of European Patent Application No. 14162536.8, filed Mar. 31, 2014, which is incorporated herein by reference.

The present invention relates to a labelling group and to a method for applying a plurality of labels onto respective articles, in particular containers filled with a pourable food product.

Labelling machines are known which substantially comprise:

- a rotary carousel, which conveys along an arch-shaped trajectory a succession of articles to be labelled from an input station to an application station and conveys labelled articles from the application station to an output station; and
- at least one labelling group, which feeds and applies a plurality of labels on respective articles at the application station.

Labelling machine is known as "roll-feed", in which the labelling group substantially comprises:

- a shaft for rotatably supporting a reel off which a strip of labels is unwound and fed along a feed path;
- a plurality of unwinding rollers for guiding the strip along a rectilinear feed path;
- a cutter for cutting a sequence of single labels from the strip;
- a transfer drum for advancing each label which has been previously cut; and
- a gluing drum for applying glue onto each previously cut label.

In particular, a conventional transfer drum is rotatable about an axis, comprises an outer surface which receives a succession of cut labels and covered with glue, and releases those labels at the application station after rotation about its own axis of a certain angle.

In greater detail, the transfer drum advances the cut labels along an arch-shaped trajectory, which is tangent to the articles at the application station.

Still more precisely, the surface of the transfer drum comprises a plurality of air ports, which form a number of conveying sections bounded, each, by a pair of damping pads.

Furthermore, the transfer drum is mounted on a stationary distributor member, which is fluidly connected to a vacuum source and to the air ports of the surface.

The air ports contacting each label are connected in fluidic way with the source of vacuum, as the label advances towards the application station. In this way, the label is retained over the surface.

When being retained by the transfer drum, each label typically has its leading edge held on one pad and its trailing edge held on the other pad.

When each label reaches the application station, the fluidic connection between the air ports and the vacuum source is interrupted, so that the labels can be released and wound onto the respective article.

European patent application no. 13179196.4, in the name of the same Applicant, discloses a labelling group, in which the labels conveyed by the transfer drum can be selectively discarded, without having been applied on the respective articles.

Furthermore, the transfer drum can selectively transfer the labels to a discarding station, which is arranged downstream of the application station with reference to the advancing direction of the transfer drum.

In greater detail, the transfer drum transfers the labels to the discarding station, during the start-up and shut down phases of the labelling group, so as not to transfer the labels to the articles until a proper timing is achieved between the rate of the labels conveyed by the transfer drum and the rate of the articles advanced by the carousel.

In this way, the transfer drum can accelerate to a very high speed without applying labels onto articles and can be therefore matched, only when it has reached the very high speed, with the carousel travelling at the very high speed.

In other words, the transfer drum can be efficiently employed in a labelling machine, which operates at very high rate.

Alternatively, the transfer drum transfers the labels to the discarding station, when a gap occurs in the sequence of articles advanced by the conveyor.

In particular, in order to transfer the labels to the discarding station with no application on the articles, the fluidic connection between the air ports and the vacuum source is established up to the discarding station.

Furthermore, the transfer drum comprises a sucking device, which is arranged at the discarding station and collects all the labels discarded by the transfer device.

Even if well performing, the above-identified solution leaves room for improvement.

In particular, in that solution, the transfer drum is permanently tangential, at the application station, to the outer surface of advancing the articles conveyed by the carousel.

As a result, even if it does not transfer the labels onto respective article, the transfer drum contacts the articles at the application station.

There is, therefore, the risk that the transfer drum could dirty, e.g. with residues of glue, the articles, thus rendering the latter no longer usable and therefore generating a loss of articles.

It is an object of the present invention to provide a labelling group for applying labels onto respective articles, which solves at least one afore-mentioned drawback connected with the known labelling groups in a straightforward, low-cost manner.

According to the present invention, there is provided a labelling group for applying labels onto respective articles, as claimed in claim 1.

The present invention also relates to a method for applying labels onto respective articles, as claimed in claim 14.

In the following a preferred, non-limiting embodiment of the present invention will be described by way of example with reference to the accompanying drawings, in which.

Figure 1:
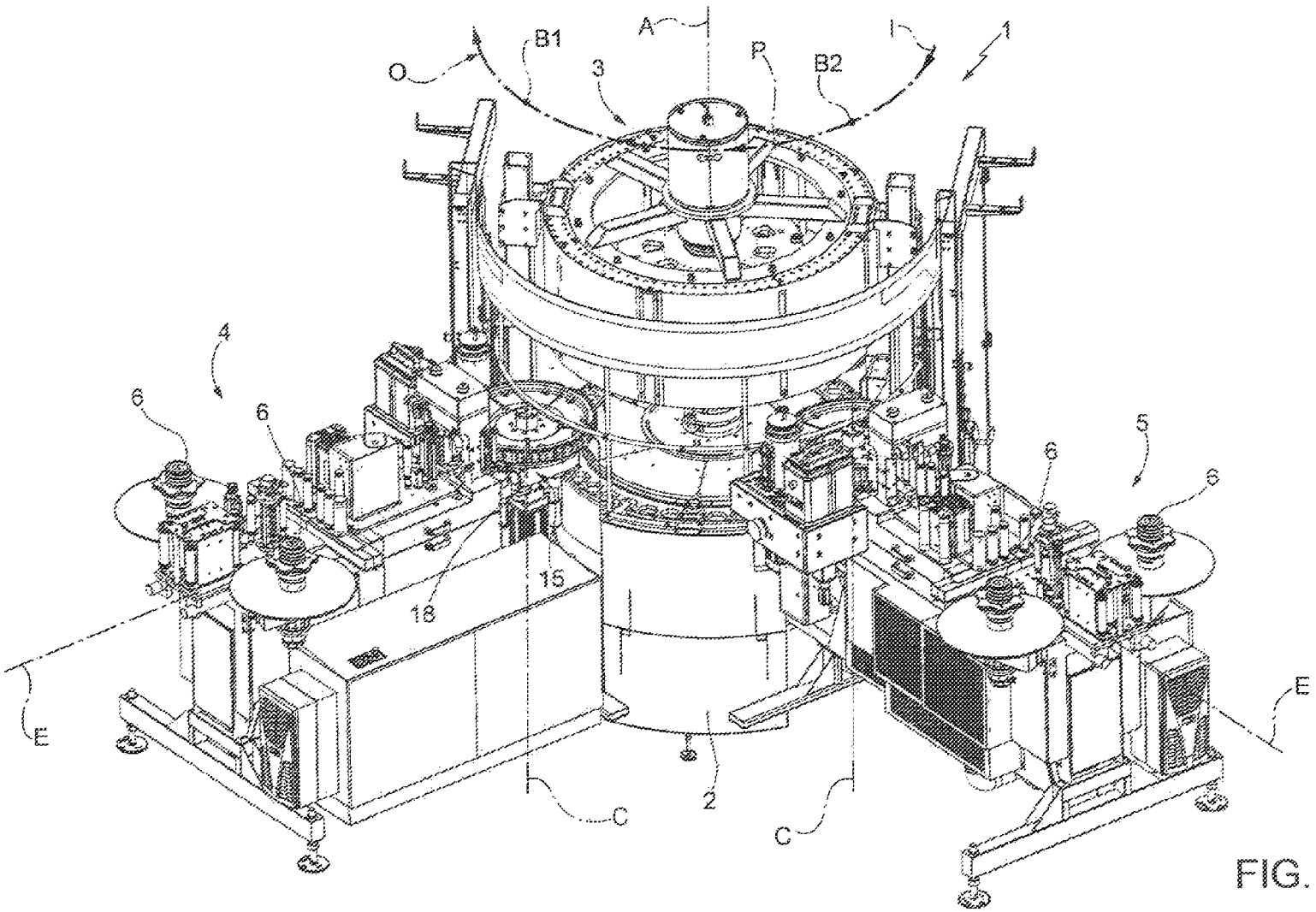
FIG. 1 is a perspective view of a labelling machine with two labelling group according to the present invention.
Figure 2:
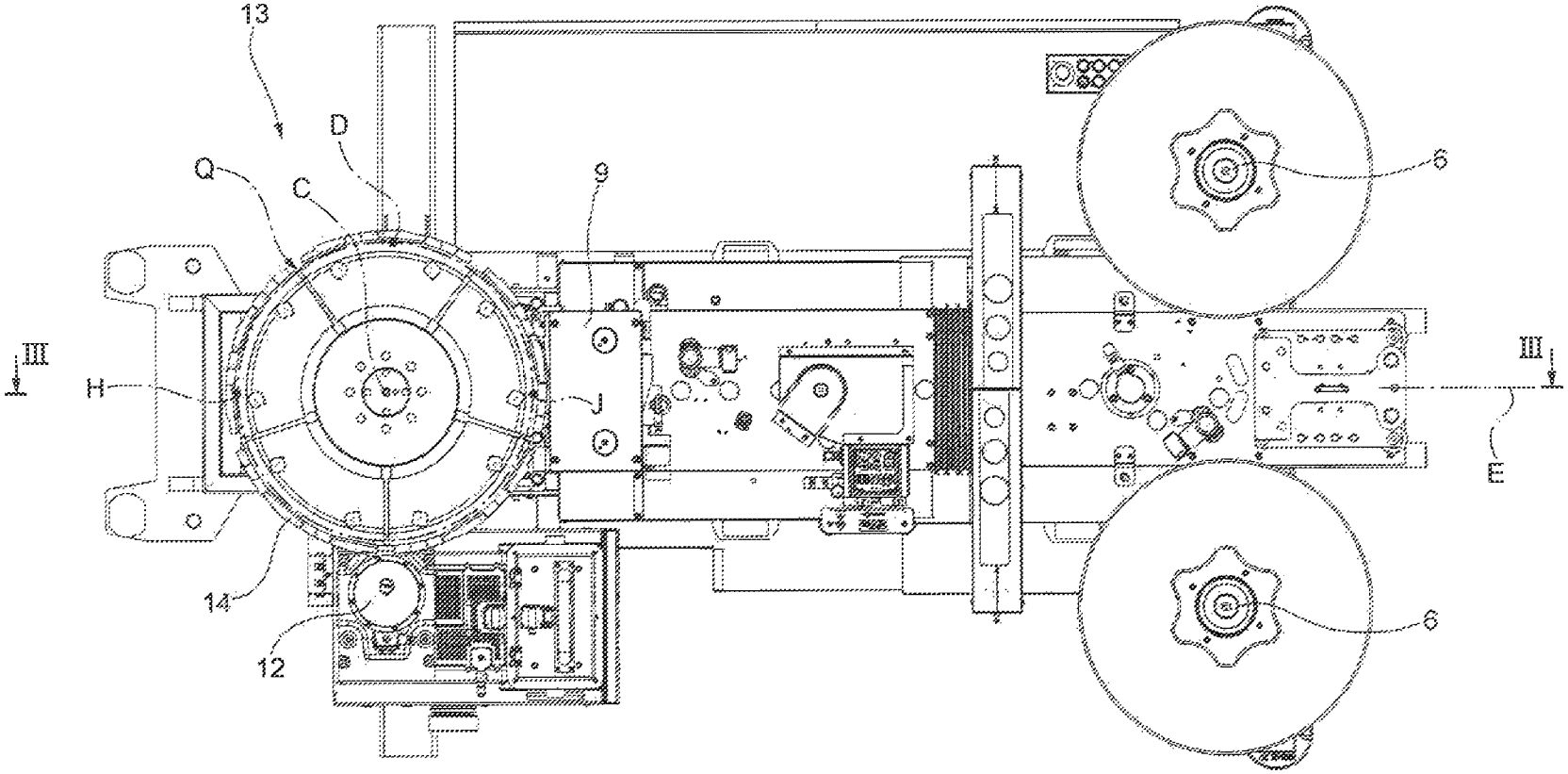
FIG. 2 is a top view of one of the labelling group of FIG. 1.

Number 1 in FIG. 1 indicates as a whole a labelling machine for applying labels 10 to respective articles 11, 11*a*, 11*b* (shown in FIGS. 12 to 21), containers for pourable food product in the embodiment shown.

In particular, labelling machine 1 is a so-called "roll-fed" labelling machine.

Labelling machine 1 substantially comprises (FIG. 1):

- a stator 2;
- a carousel 3, which rotates about an axis A, vertical in use, with respect to stator 2, and advances a succession of spaced articles 11, 11*a*, 11*b* along an arc-shaped path P;
- a pair of labelling groups 4, 5, which are arranged on the periphery of carousel 3.

Labelling machine 1 is incorporated in a plant 100 for producing labelling articles 11, 11*a*, 11*b*.

Plant 100 is only partly shown in FIGS. 12 to 21 and substantially comprises:

- a conveyor 101 (shown only in FIGS. 12 to 21) for feeding a plurality of pre-forms 108;
- a switch 111 selectively operable for interrupting for a given time the flow of pre-forms 108
- a blowing machine (not-shown) for blowing the pre-forms 108 and forming respective articles 11, 11*a*, 11*b;*
- a filling machine (not-shown) for filling articles 11, 11*a*, 11*b* with the pourable product;
- labelling machine 1; and
- a capping machine (not-shown) for applying a plurality of caps onto respective articles 11, 11*a*, 11*b*.

Alternatively, labelling machine 1 could be interposed between the blowing machine and the filling machine.

In greater detail, path P comprises:

- an input station I, at which carousel 3 is fed with articles 11, 11*a*, 11*b* to be labelled;
- an output station O, at which carousel 3 outputs labelled articles 11, 11*a*, 11*b*; and
- an application station B, which is interposed between input station I and output station O.

In the embodiment shown, path P is shaped as an arch of circumference having centre on axis A.

Each labelling group 4, 5 applies a succession of labels 10 onto respective articles 11, 11*a*, 11*b*.

In particular, each label 10 is applied at application station B onto a relative article 11, 11*a*, 11*b*.

Each labelling group 4, 5 substantially comprises (FIGS. 2 and 12 to 21):

- a pair of shafts 6 for rotatably supporting relative reels 7 (shown only in FIGS. 12 to 21) off which a strip 8 of labels 10 is unwound and fed along a feed path towards application station B;
- a plurality of unwinding rollers 16 for guiding backing web along the feed path;
- a cutting element 9 for cutting, one after the other, labels 10 from strip 8;
- a glue roller 12 for applying glue onto cut labels 11; and
- a transfer system 13 for transferring cut and glue-covered labels 10 along an arc-shaped trajectory Q having centre on an axis C from an input station J either to application station B or to a discarding station D.

In particular, transfer system 13 transfers labels 10 to be applied on respective articles 11, 11*a*, 11*b* from input station J to transfer station H, whereas it transfers labels 10 to be discarded from input station J to discarding station D.

During application of labels 10 on relative articles 11, transfer element 13 is arranged in an operative position (shown in FIGS. 14, 15, 17 and 19), in which trajectory Q is tangent to articles 11*a*, 11, 11*b* travelling along path P at application station B.

In greater detail, when transfer element 13 is in the operative position, transfer station H is coincident with application station B.

Discarding station D is arranged downstream of transfer station H, proceeding according to the advancing rotation direction of drum 15.

Application station B is arranged at a first angular distance from input station 3 and discarding station D is arranged at a second angular distance form station J. The second angular distance is greater than the first angular distance.

Axis C is parallel and distinct from axis A.

With reference to FIGS. 1, 10, 11 and 12 to 21, transfer system 13 substantially comprises:

- a stator 14;
- a drum 15, which is supported above stator 14 in a rotatable manner about axis C;
- a diverting device 20, which can be arranged in a first configuration (shown in FIGS. 12 to 21 by a substantially vertical arrow directed towards carousel 3) in which it allows drum 15 to transfer labels 10 to be applied onto respective articles 11, 11*a*, 11*b* from station J to transfer station H, or in a second configuration (shown in FIGS. 12 to 21 by a substantially horizontal arrow directed towards discarding station D) in which it allows drum 15 to transfer labels 10 to be discarded from station J to discarding station D; and
- a sucking device 21 (only schematically shown in FIGS. 12 to 21), which is arranged at discarding station D and which receives labels 10 to be discarded at discarding station D.

Figure 10:
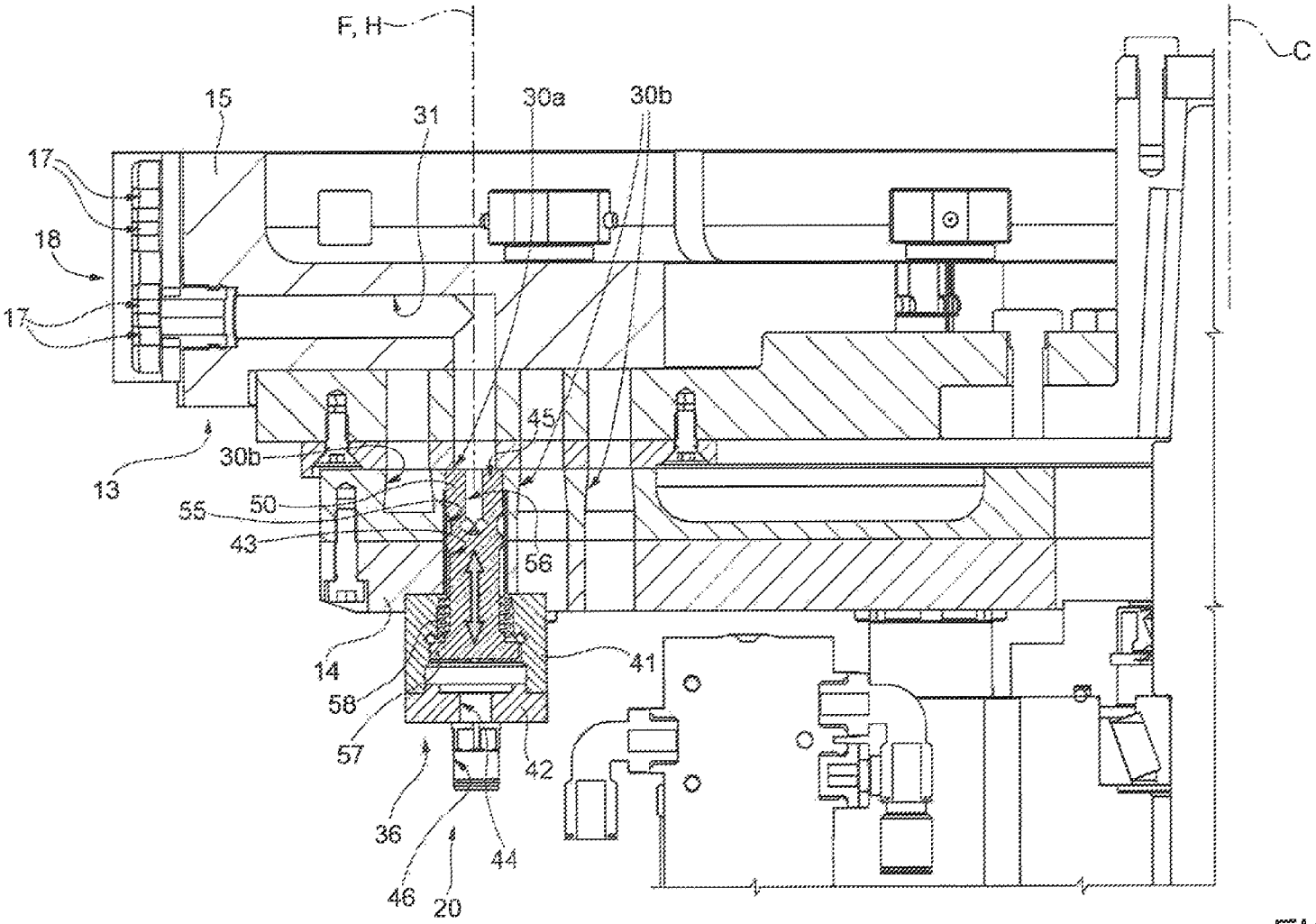
FIGS. 10 and 11 are enlarged sections of the labelling group of FIGS. 2 to 10, showing the diverting device in a first configuration and in a second configuration respectively.
Figure 11:
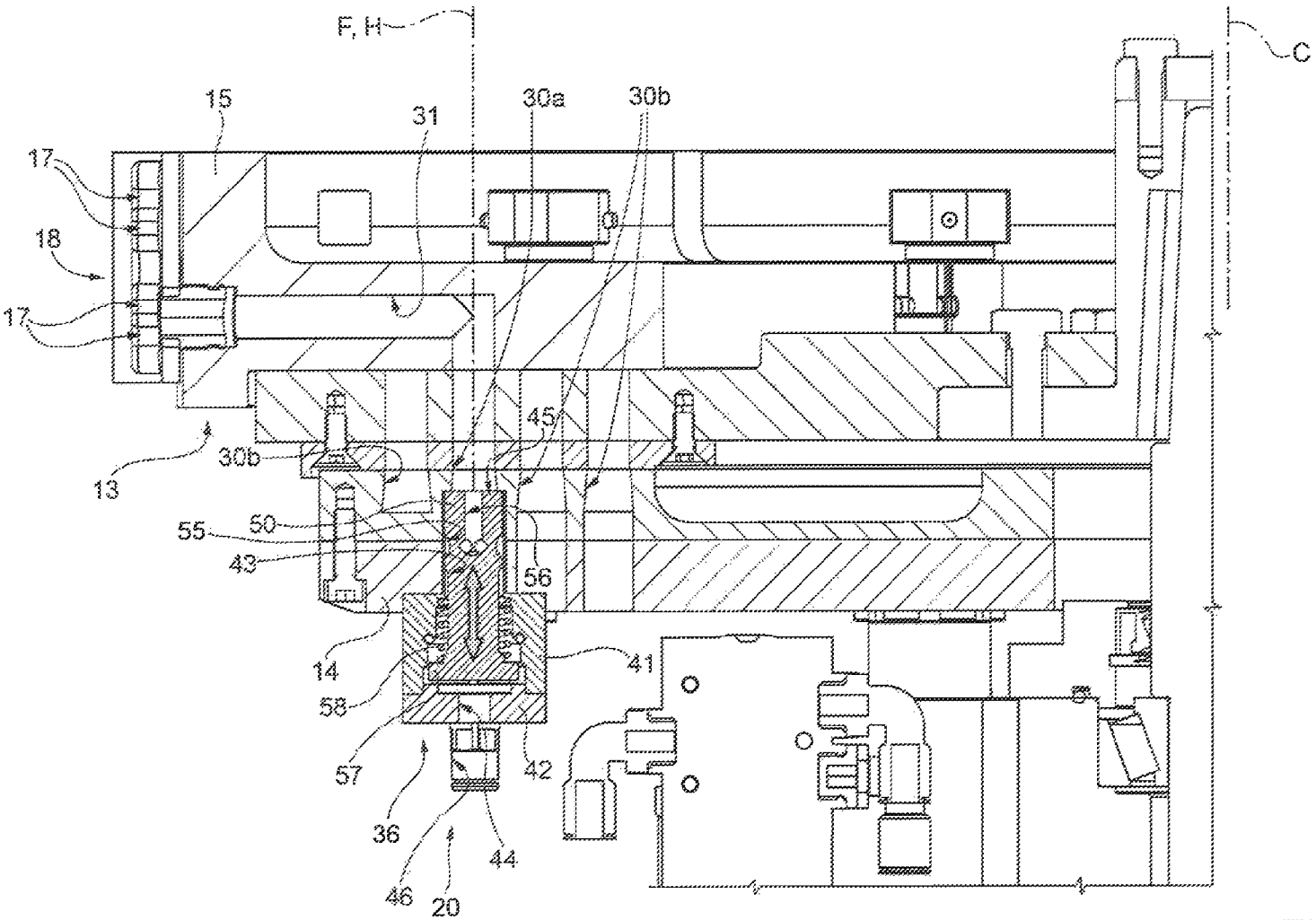

Stator 14 comprises, in turn, a plurality of vacuum sources arranged in respective stationary channels 30*a*, 30*b* shaped as arch having centre on axis C (FIGS. 10 and 11).

Drum 15 is independently driven by a motor (not shown) about axis C.

Drum 15 comprises, in turn, a lateral outer surface 18 extending cylindrically about axis C.

Surface 18 comprises a plurality, five in the embodiment shown, of conveying sections adapted to convey respective labels 10 along the arch-shaped trajectory.

Each conveying section is circumferentially bounded by an upstream elastic pad and by a downstream elastic pad, which are angularly spaced from one another.

Drum 15 comprises (FIGS. 10 and 11):

a plurality of channels 31 (only one of which is shown in FIGS. 10 and 11), shaped as arches having common centre on axis C; and a plurality of air ports 17 defined by surface 18 and arranged both in conveying sections and in downstream pad and upstream pad.

Channels 30*a*, 30*b*; 31 extend at given distances from axis A and for given arches about axis C.

In particular, for some angular positions of drum 15, one of channels 31 is superimposed to at least one respective channel 30*a*, 30*b*.

In this way, air ports 17 are connected to the vacuum source and can exert a suction action on label 10.

For some other angular positions of drum 15, channels 31 interact with different sections of from channels 30*a*, 30*b*.

Accordingly, for these other angular positions of drum 15, air ports 17 are fluidly disconnected from the vacuum source and do not exert any suction action on label 10.

In greater detail, at station J, air ports 17 of the upstream pad of each conveying section are fluidly connected with the vacuum source, so as to suck the trailing edge of respective label 10.

As each conveying section rotates about axis C from station J to transfer station H, respective air ports 17 of that conveying station and of the downstream pad are connected with the vacuum source, so as to suck the remaining part of respective label 10.

In this way, each label 10 is advanced from station J to transfer station H with its leading edge held on the upstream pad and its trailing edge held on the downstream pad.

In particular, when each label 10 reaches transfer station H, channels 30*a*, 31 are superimposed.

When diverting device 20 is arranged in the first configuration, the fluidic connection between air ports 17 travelling at transfer station H and the vacuum source is interrupted.

In this way, each label 10 is gradually released by drum 15 and transferred outside drum 15 at transfer station H.

As it will evident from the foregoing of the present description, when diverting device 20 is arranged in the first configuration, air ports 17 travelling at transfer station H eject an air jet on label 10, so as to ease the release of labels 10 at transfer station H.

When diverting device 20 is arranged in the second configuration, the fluidic connection between air ports 17 travelling at transfer station H and the vacuum source is maintained.

Furthermore, when diverting device 20 is arranged in the second configuration, air ports 17 do not eject any air jet on labels 10 travelling at transfer station H.

In this way, labels 10 can reach discarding station D, whereat they are sucked by sucking device 21.

Diverting device 20 substantially comprises (FIGS. 9 to 11):

a plurality of electro-valves 35*a*, 35*b*, 35*c*; and an actuator 36, which is controlled by electro-valve 35*a*, 35*b*, 35*c* for selectively interrupting the fluidic connection between air ports 17 travelling at transfer station H and vacuum source or for selectively causing air ports 17 travelling at transfer station H to eject a jet of air onto label 10, so as to ease the release of label 10 at transfer station H.

In greater detail, actuator 36 is arranged on stator 14 at transfer station H and comprises, in turn, a housing 41 fitted to stator 14; and a shutter (or locking piston) 45 movable inside a seat 43 of housing 41 along an axis F parallel to axis C between a first position and a second position; and a flange 42 fitted to housing.

Seat 43 opens, on one side, in channel 30*a* and, on the other side, in a hole 44 of flange 42 which is connected to electro-valve 35*a* by a duct 46.

Shutter 45 comprises, in turn, a stem 50 elongated along axis F and arranged on the side of channel 30*a*; and a base 57 enlarged with respect to stem 50, orthogonal to axis F, and arranged on the side of flange 42.

Stem 50 comprises an annular groove 55 which extends about axis F.

Furthermore, stem 50 defines a duct 56 which is fluidly connected with groove 55 and is fluidly connected with channel 30*a* (FIGS. 8, 9, 10 and 11).

When shutter 45 is in the first position (raised in FIG. 10), stem 50 fully engages channel 30*a*, thus interrupting the fluidic connection between the vacuum source and channel 31 connected to air ports 17 travelling at transfer station H. In this way, no vacuum action is exerted on label 10 travelling at transfer station H.

Furthermore, when the shutter 45 is in the first position, base 57 is spaced along axis F from flange 42 and abuts against a shoulder defined by housing 41.

When the shutter 45 is in the second position, stem 50 leaves free part of channel 30*a*, thus maintaining the fluidic connection between the vacuum source and channel 31*a* connected to air ports 17 travelling at transfer station H. In this way, the vacuum action is exerted on label 10 travelling at transfer station H.

Furthermore, when the shutter 45 is in the second position, base 57 contacts flange 42 and is spaced by shoulder.

Electro-valve 35*a* can be actuated for generating a flow of air in pressure inside duct 46, thus increasing the pressure in the volume between flange 42 and base 57 and causing shutter 45 to move from the second position to the first position parallel to axis F.

Base 57 is elastically connected to flange 42 by a spring 58, which causes the return of shutter 45 from the first position to the second position.

Figure 9:
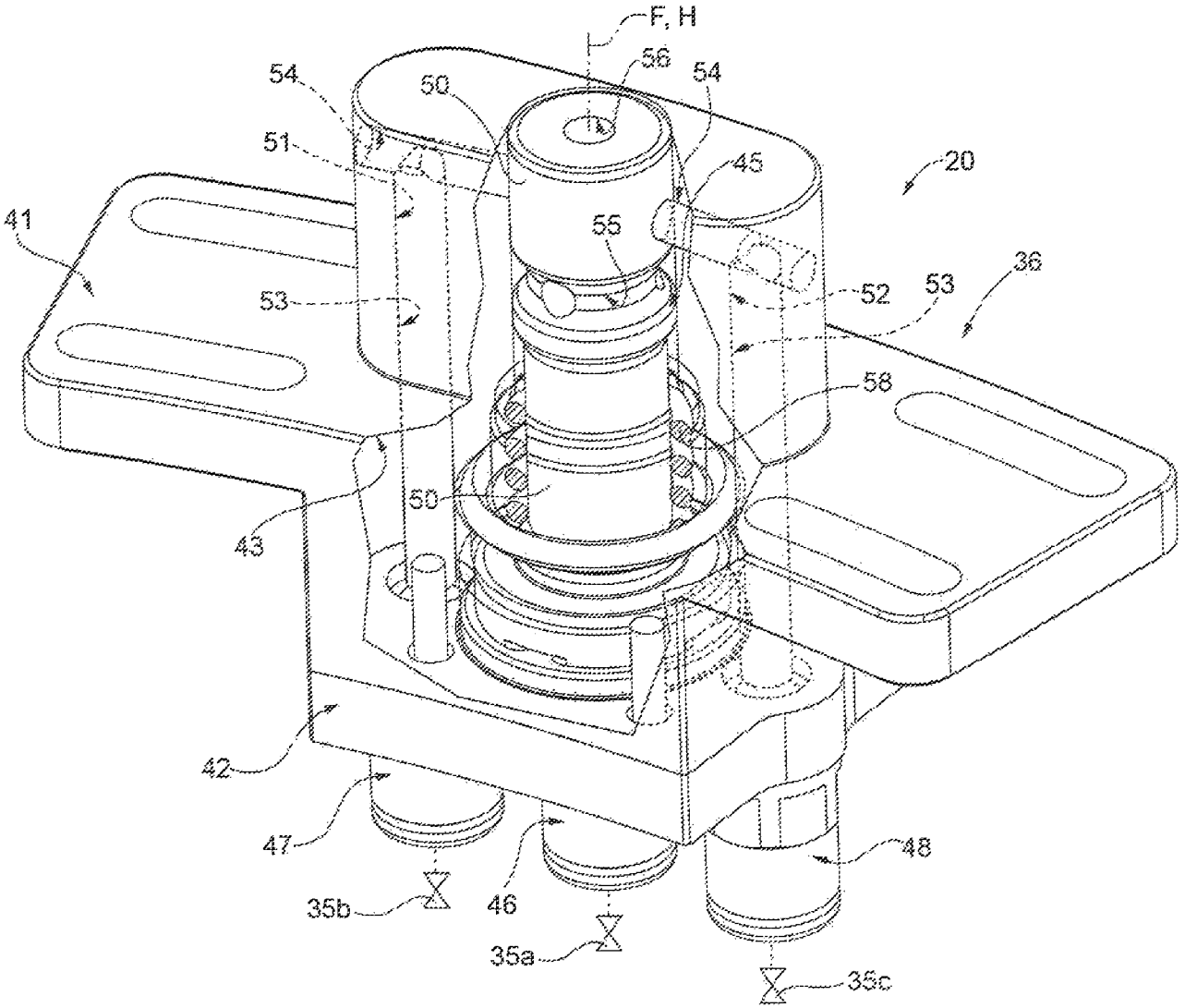
FIG. 9 is a further enlarged view of the diverting device of FIG. 8.

Housing 41 also comprises a pair of channels 51, 52, between which seat 43 is arranged (FIG. 9).

Each channel 51, 52 is fluidly connected, on one side thereof, to a respective duct 47, 48.

Each channel 51, 52 is fluidly connected with air ports 17 set at transfer station H, when shutter 45 is in the first position.

Each channel 51, 52 is fluidly isolated by air ports 17 set at transfer station H, when shutter 45 is in the second position.

More precisely, each channel 51, 52 also comprises:

a portion 53 parallel to axis F and originating from a hole 49*a*, 49*b* (FIG. 8) of flange 42 connected to electro-valve 35*b*, by means of respective ducts 47, 48; and a portion 54 orthogonal to axis F and opposite to respective hole 49*a*, 49*b* of flange 42.

When shutter 45 is in the first position, groove 55 faces portions 54 of channels 51, 52, thus establishing a fluidic connection between ducts 47, 48 and air ports 17 arranged at transfer station H, by means of superimposed channels 30*a*, 31.

In this way, when shutter 45 is in the first position (FIG. 10), air ports 17 travelling at transfer station H eject a jet of air on label 10.

When shutter 45 is in the second position (FIG. 11), groove 55 is staggered from portion 54 along axis F, thus fluidly isolating ducts 47, 48 and air ports 17 travelling at transfer station H.

Accordingly, when shutter 45 is in the second position, no jet of air is ejected on label 10 travelling at station A.

Advantageously, transfer element 13 of each labelling group 4, 5 is movable in a fully rest position, in which trajectory Q is spaced from application station B (FIGS. 12, 13, 16, 18, 20 and 21).

In greater detail, transfer station H is spaced from application station B, when transfer element 13 is in the fully rest position.

Furthermore, diverting device 20 is set in the first configuration, when transfer element 13 is in the operative position.

On the contrary, diverting device 20 is set in the second configuration, when transfer element 13 is in the fully rest position.

Transfer element 13 can also assume a plurality of partially rest positions (not shown in FIGS. 12 to 21), which are interposed between the operative position and the fully rest position.

Preferably, diverting device 20 is set in the second configuration, when transfer element 13 is set in one of the partially rest positions (not shown in FIGS. 12, 13, 16, 18 and 20).

In particular, transfer element 13 is movable between the fully rest position and the operative position along a rectilinear path parallel to a direction E.

Direction E is, in the embodiment shown, radial to path P and trajectory Q and lies on a plane orthogonal to axes A, C.

Furthermore, labelling group 4 comprises a control unit 60 (only schematically shown in FIGS. 3, 4 and 12 to 21), which is programmed for varying the advancing speed of strip 8 and therefore, the rotational speed of drum 15, on the basis of the position of transfer element 13.

In greater detail, control unit 60 is programmed for controlling transfer element 13 in such a way that:

- the rotational speed of drum 15 is the highest, when transfer element 13 is in the operative position; and
- the rotational speed of drum 15 is the lowest, when transfer element 13 is in the fully rest position.

In the embodiment shown, drum 15 is idle, i.e. its rotational speed is null, when transfer element 13 is in the fully rest position.

Figure 12:
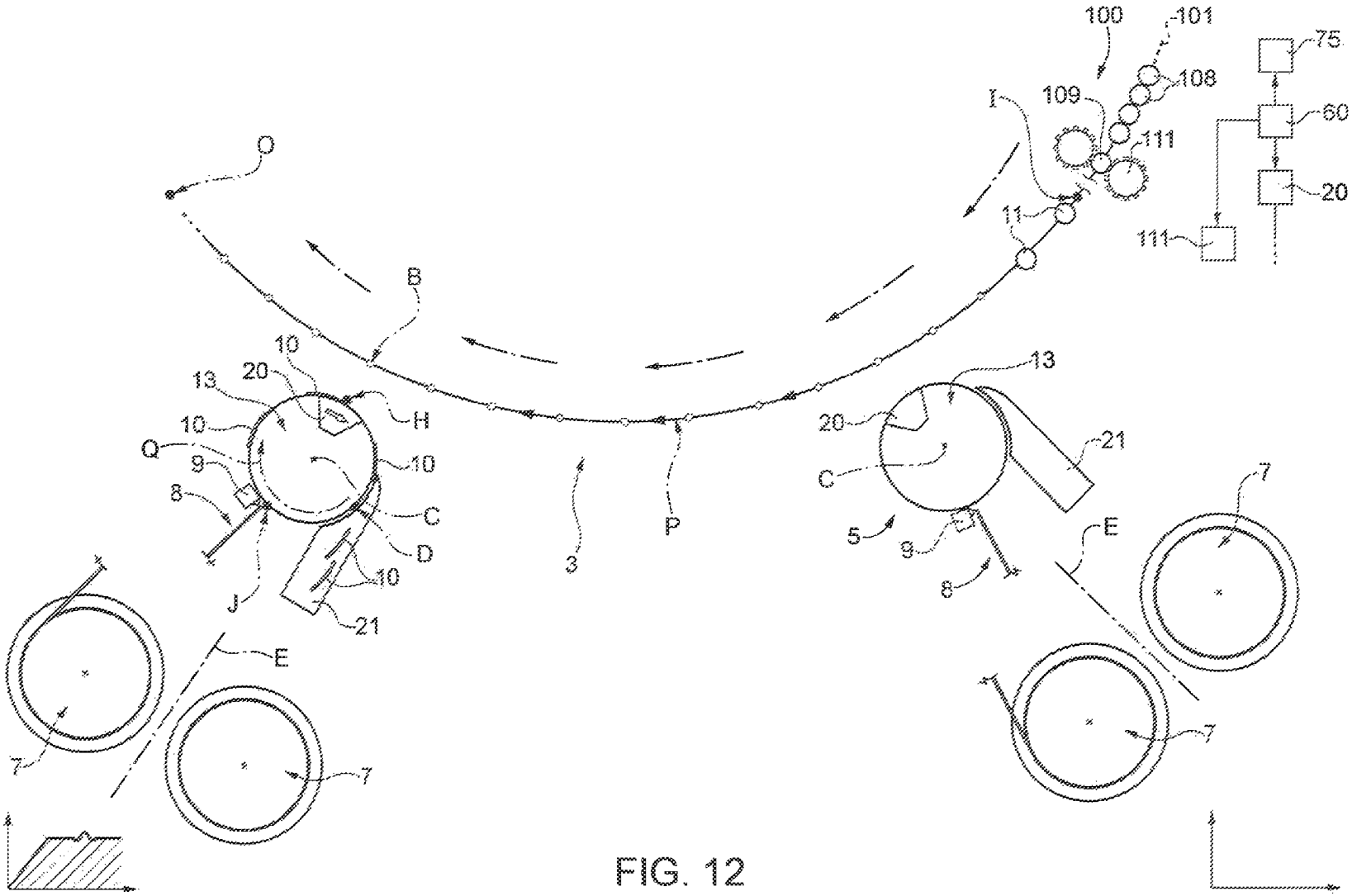
FIGS. 12 to 14 are schematic views of the labelling machine of FIG. 1 representing respective subsequent steps of a first operative scenario.
Figure 13:
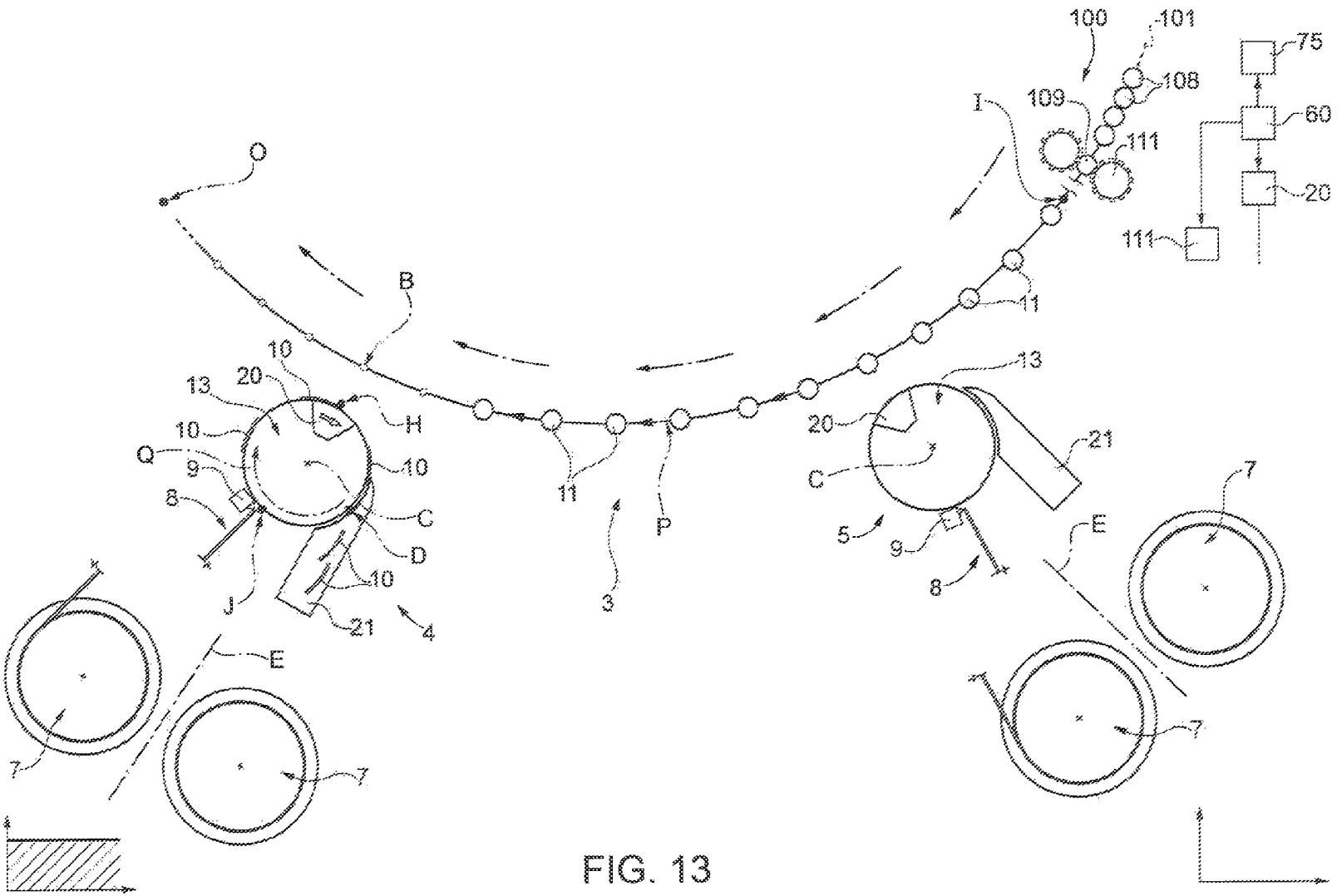
Figure 14:
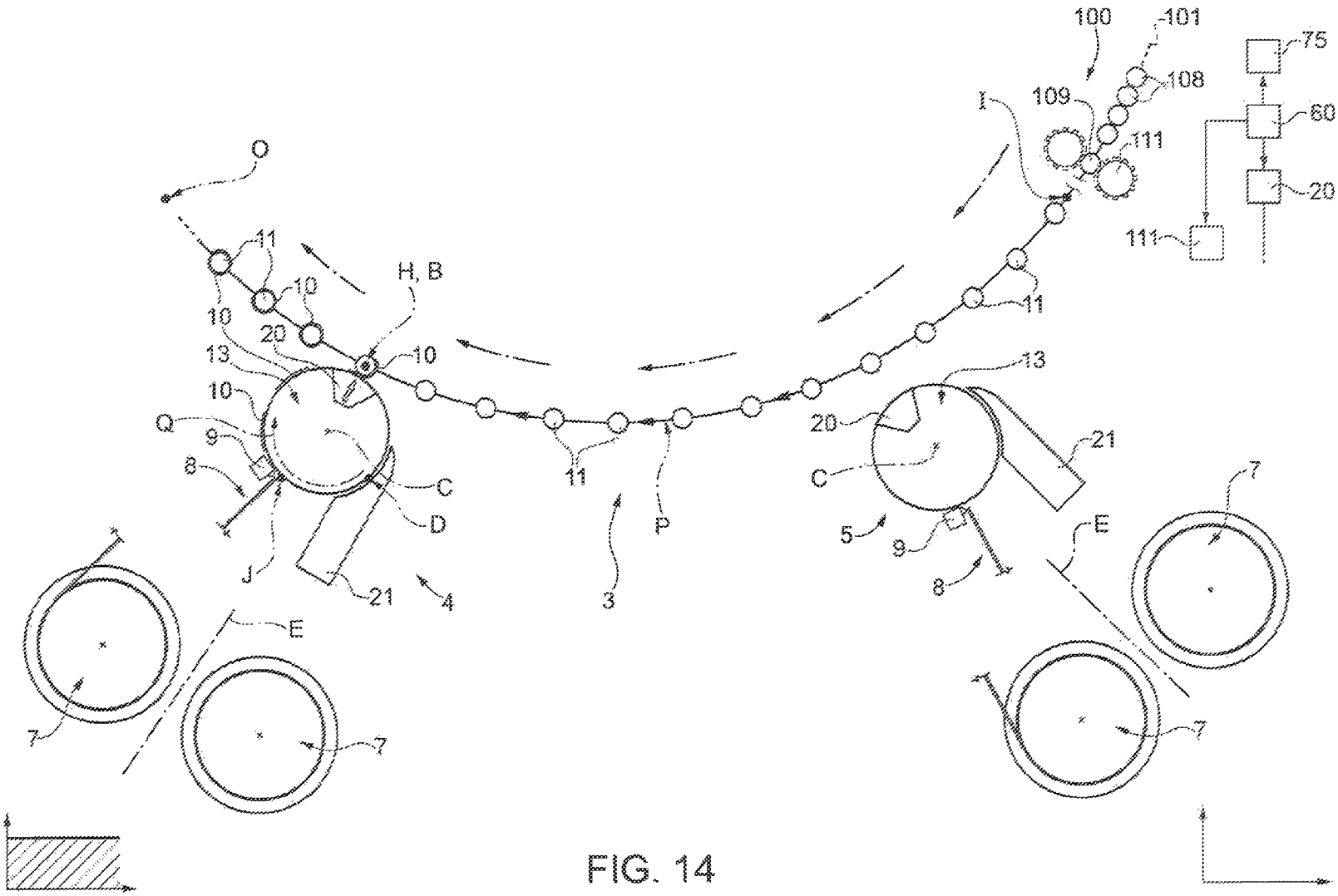

Furthermore, control unit 60 is programmed for accelerating the rotational speed of drum 15, when transfer element 13 moves from the fully rest position to the operative position, during a start-up step of labelling group 4, 5 (as shown in speed vs time plots in FIGS. 12 to 14).

Preferably, control unit 60 is programmed for accelerating the rotational speed of drum 15 according to a linear ascending ramp up to the highest speed, when transfer element 13 moves from the fully rest position to the operative position, during a start-up step of labelling group 4 (as shown in speed vs time plots in FIGS. 12 to 14).

In the embodiment shown, the highest speed is reached by transfer element 13 before the latter reaches the operative position.

Figure 19:
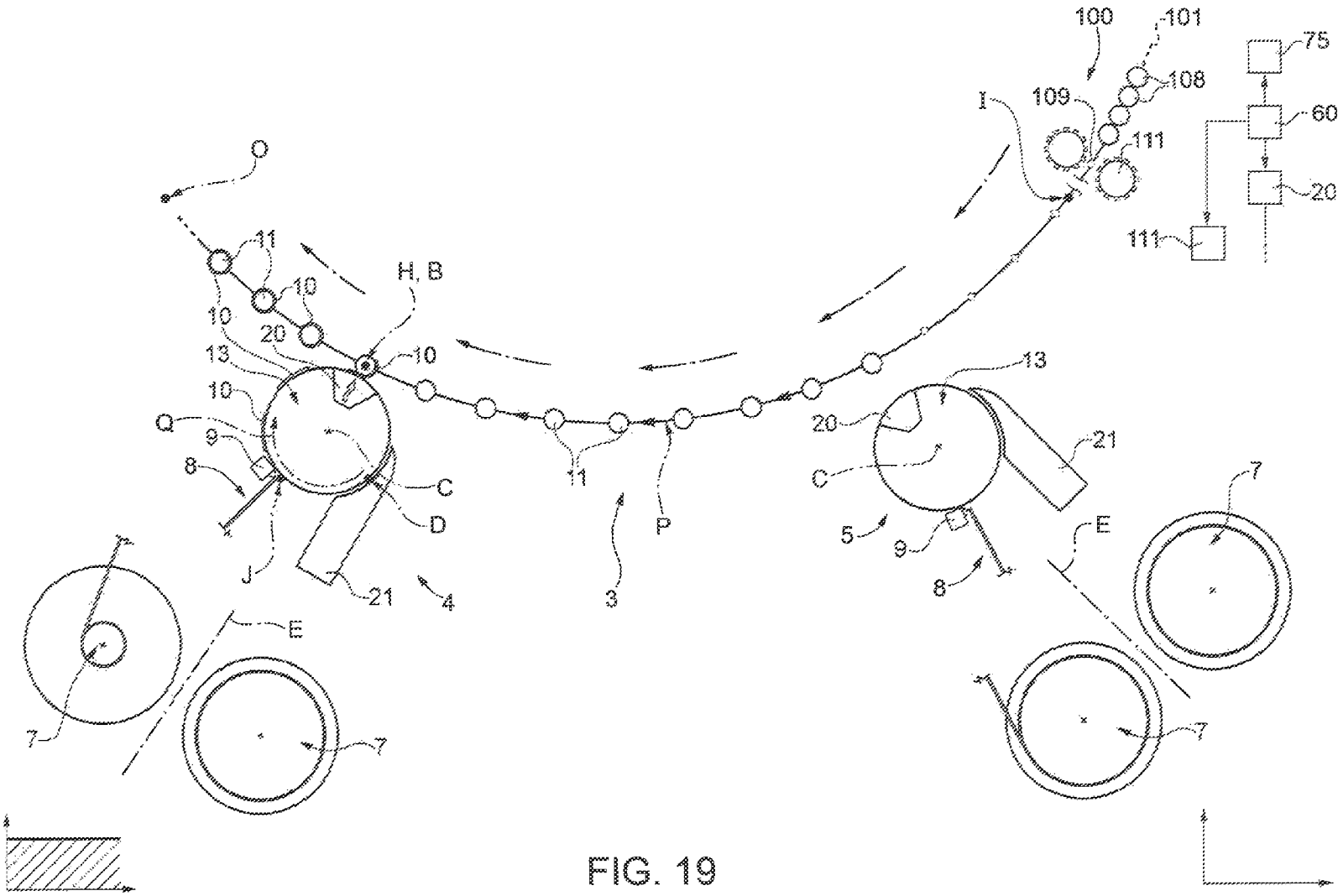
FIGS. 19 to 21 are schematic view of the labelling machine of FIG. 1 representing respective subsequent steps of a fourth operative scenario.
Figure 20:
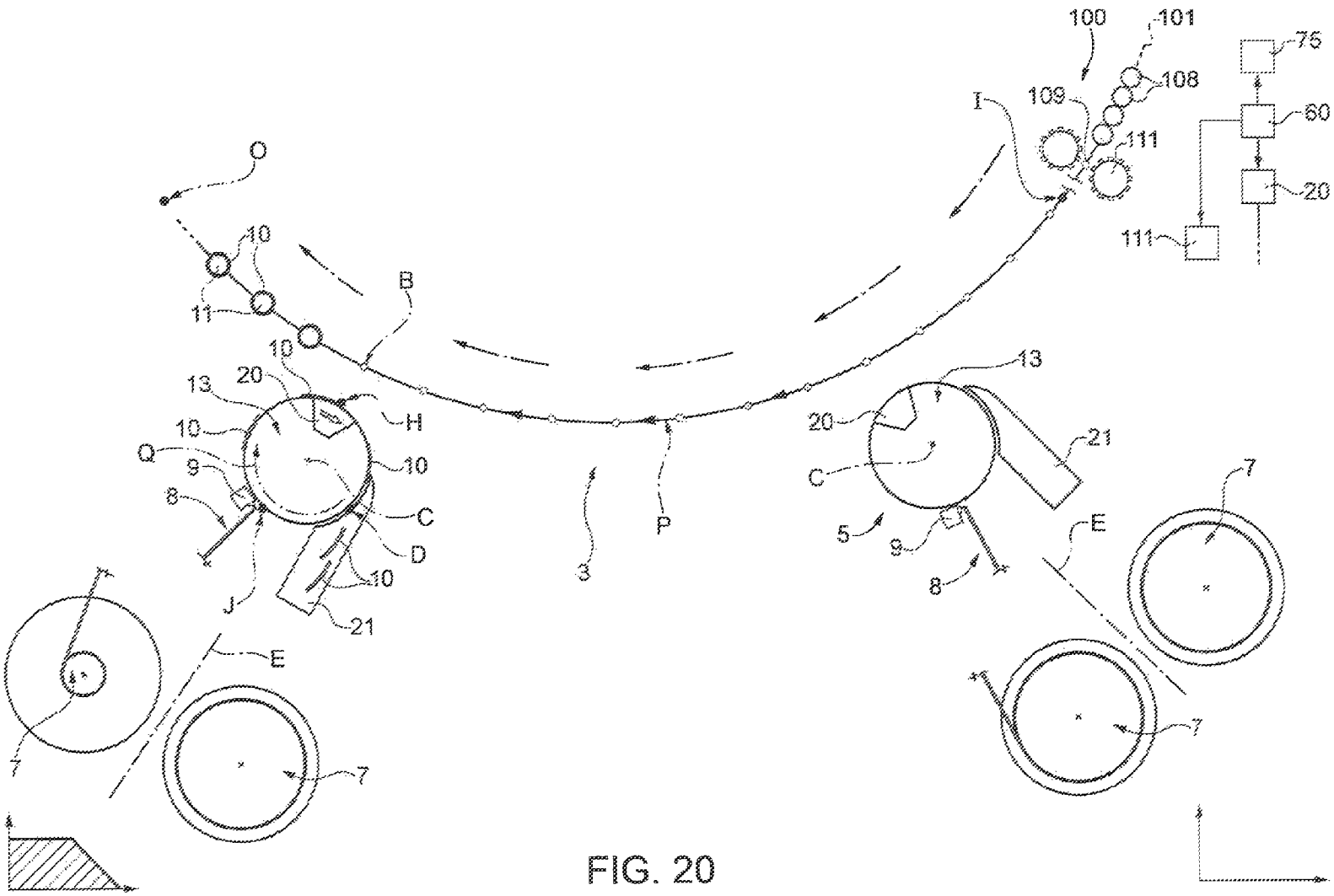
Figure 21:
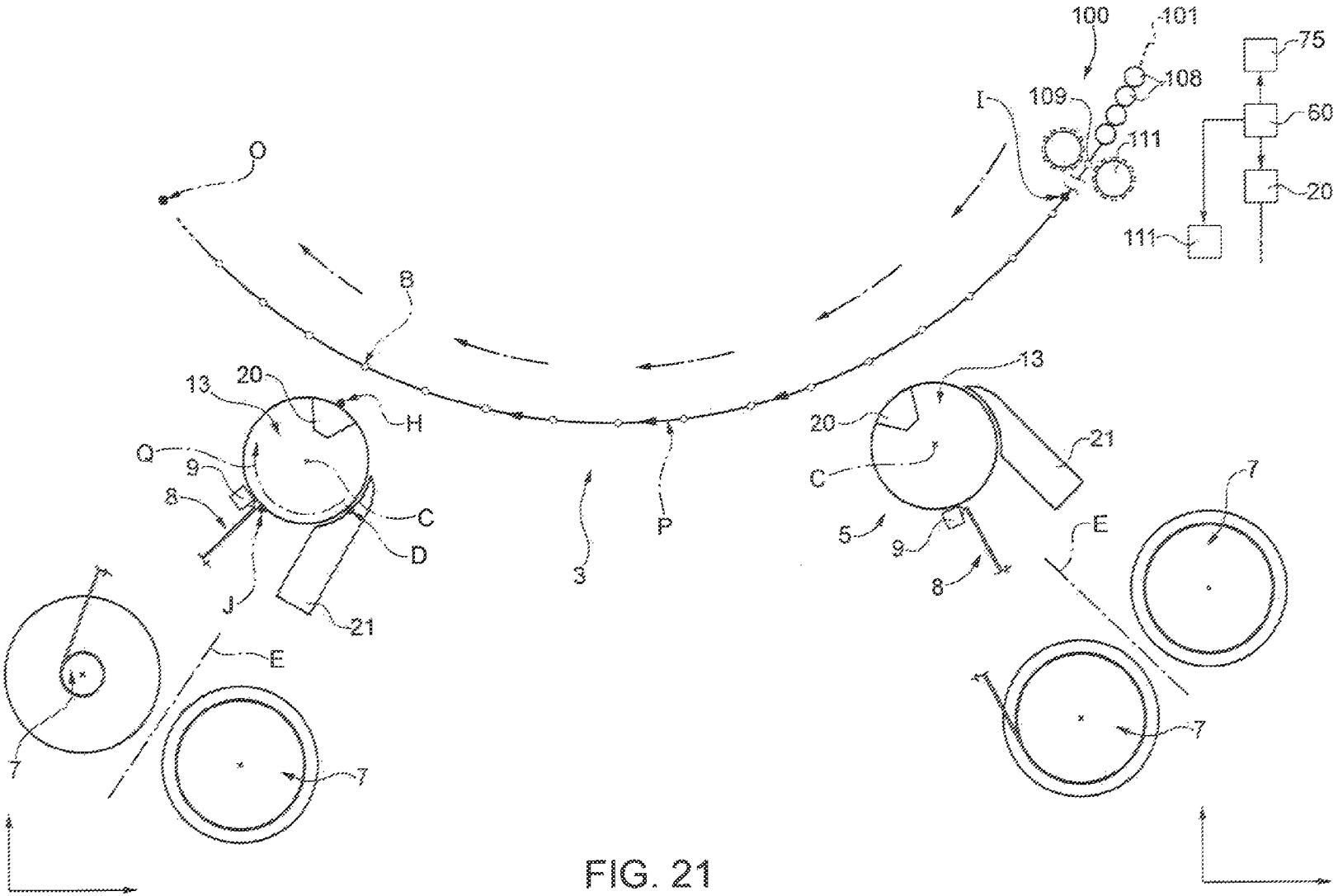

Furthermore, control unit 60 is programmed for decelerating the rotational speed of drum 15 according a linear ramp up to the lowest speed, when transfer element 13 moves from the operative position to the fully rest position (FIGS. 19 to 21).

In the embodiment shown, control unit 60 at first keeps the drum 15 at the highest value and then decelerates drum 15 according to a linear descending ramp, when transfer element 13 moves from the operative position to the fully rest position during a shut-down step of labelling group 4, 5.

Labelling group 4, 5 further comprises (FIGS. 3 to 7):

- a supporting structure 65 which supports shaft 6;
- a supporting structure 66 which supports transfer element 13; and
- connecting means 67 interposed between supporting structures 65, 66 and programmed to allow supporting structures 65, 66 to move with respect to each other parallel to direction E, so as to allow transfer element 13 to move between the fully rest position and the operative position.

In the embodiment shown, supporting structure 66 also supports cutting element 9 and glue roller 12.

Figure 6:
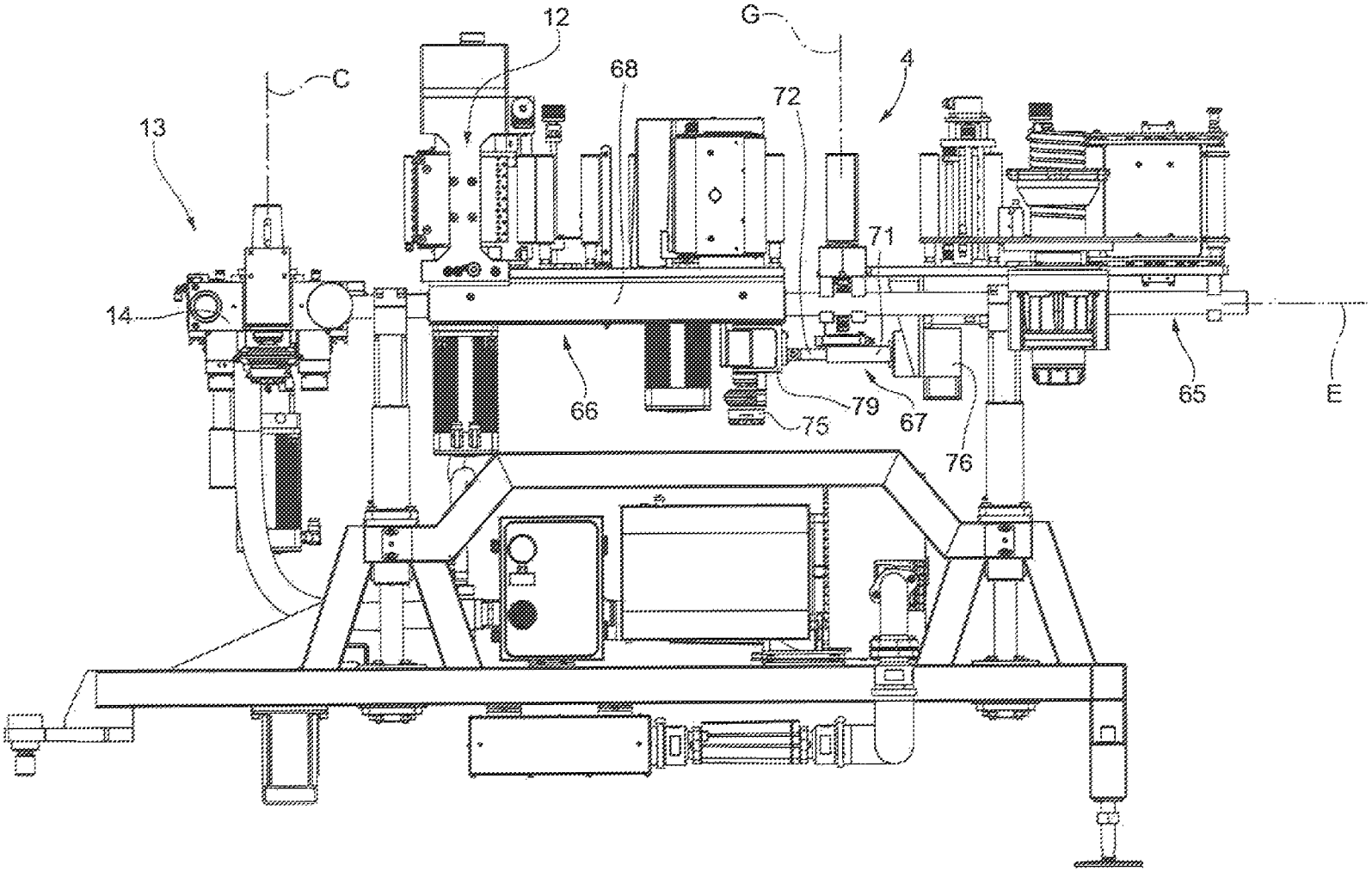
FIG. 6 is a frontal view of further components of the labelling group of FIGS. 2 to 5.
Figure 7:
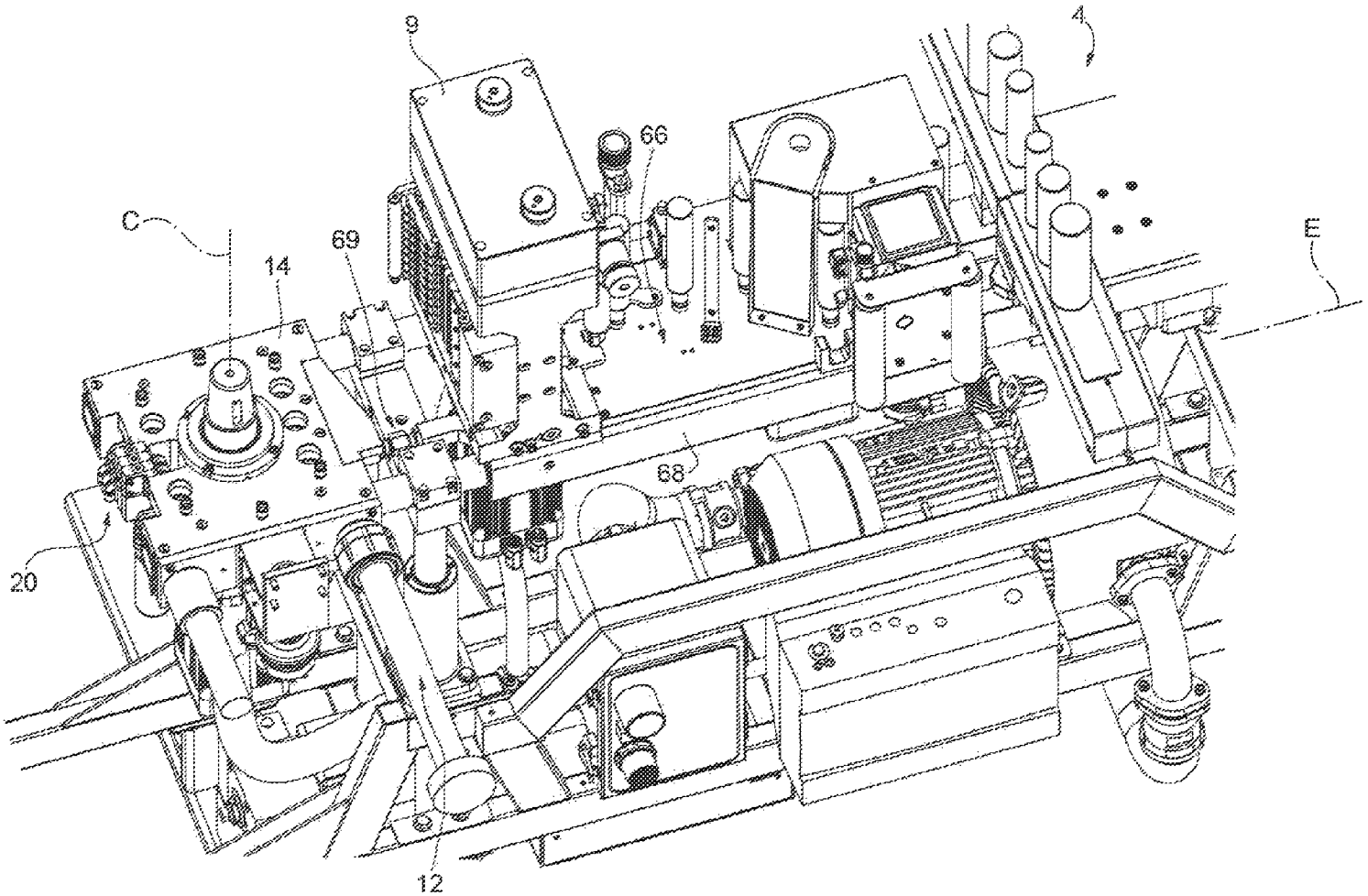
FIG. 7 is a perspective view of further components of the labelling group of FIGS. 2 to 6, with parts removed for clarity.
Figure 8:
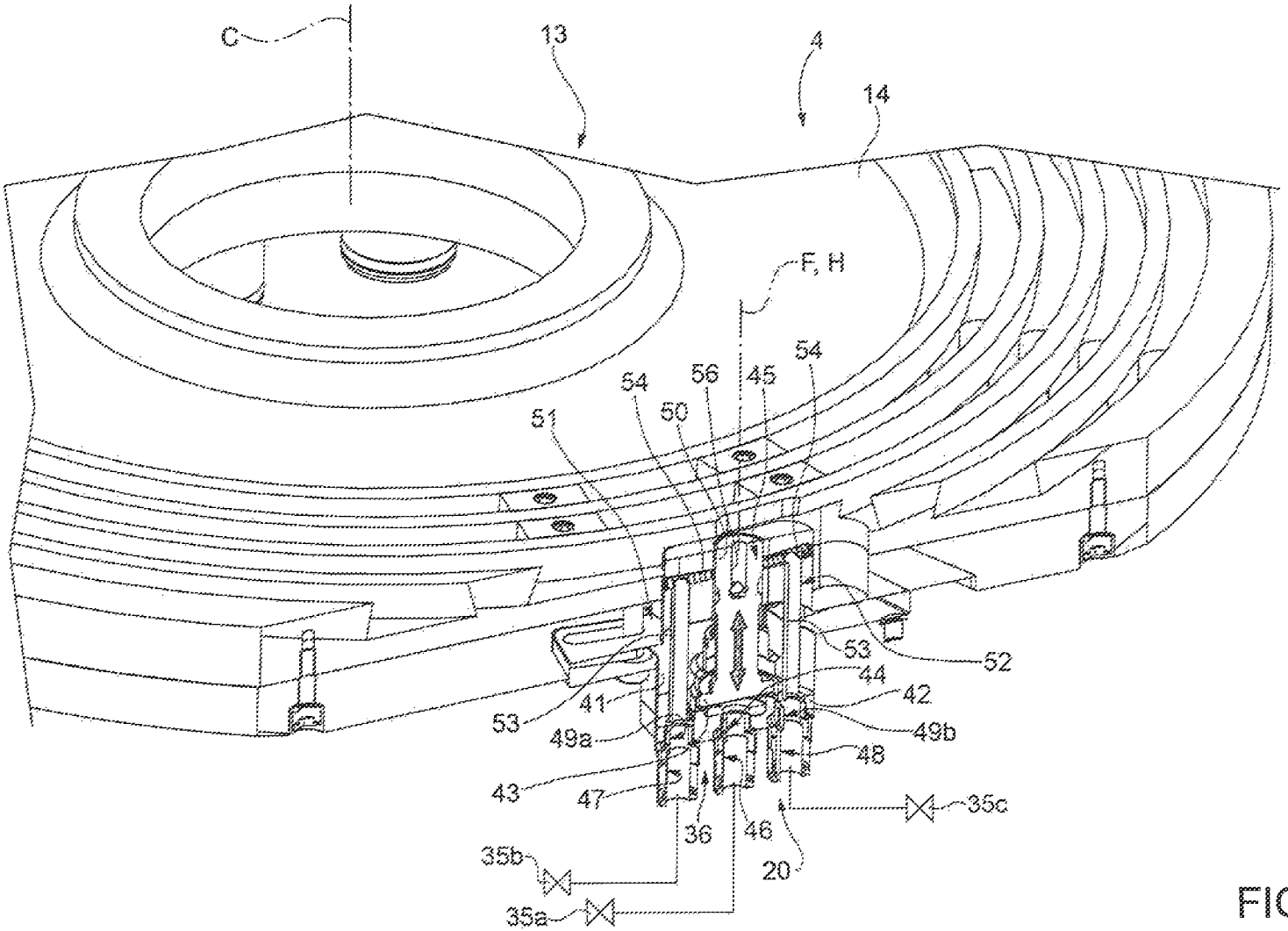
FIG. 8 is an enlarged perspective view of the labelling group of FIGS. 2 to 7 showing a diverting device, with parts removed for clarity.

With reference to FIGS. 6 and 7, supporting structure 66 comprises:

- a table 68 which supports a number of roller 16, cutting element 9 and glue roller 12 (only partially shown in FIG. 7); and
- a link 69, which is interposed between table 68 and stator 14.

Figure 3:
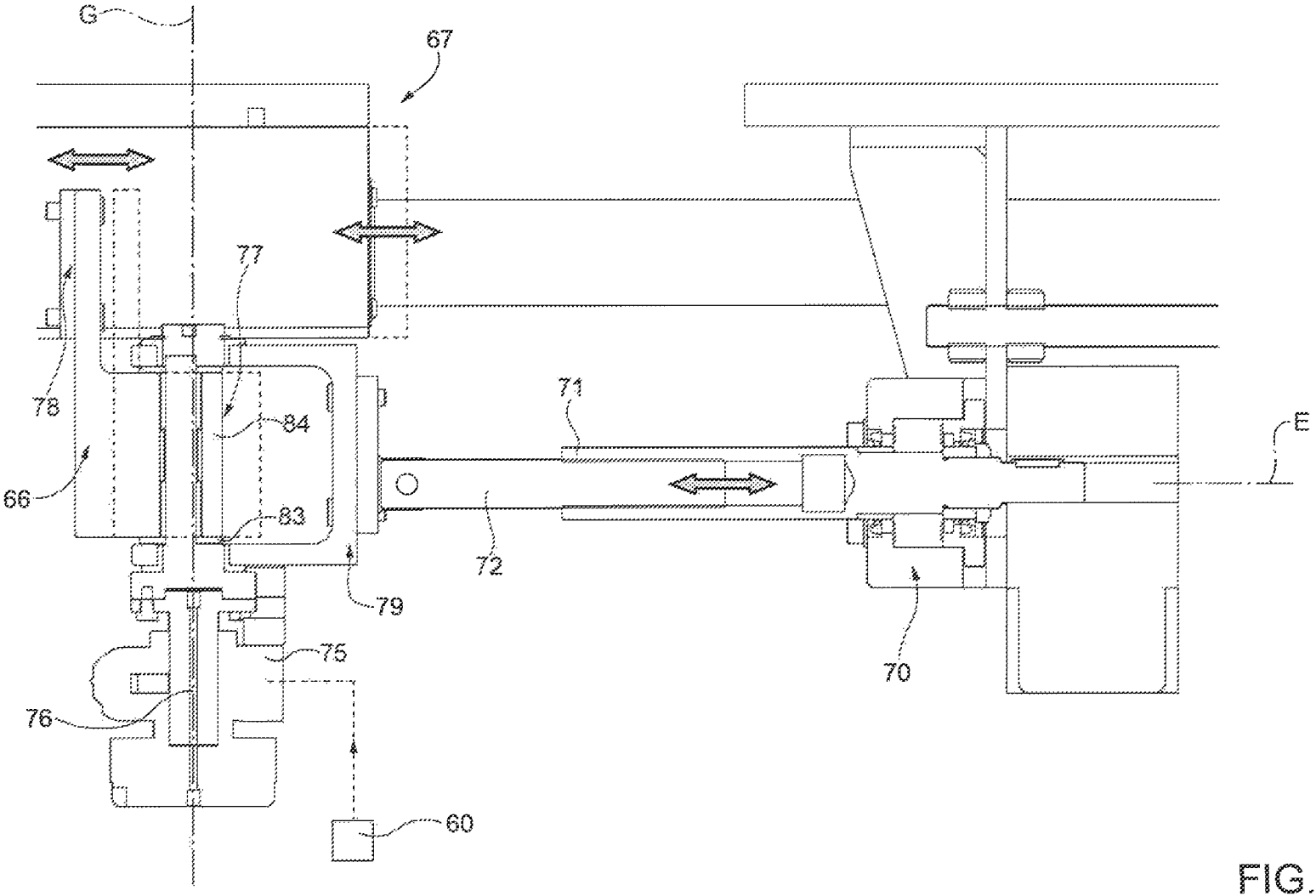
FIG. 3 is a section taken along line III-III of FIG. 2, with parts removed for clarity.
Figure 4:
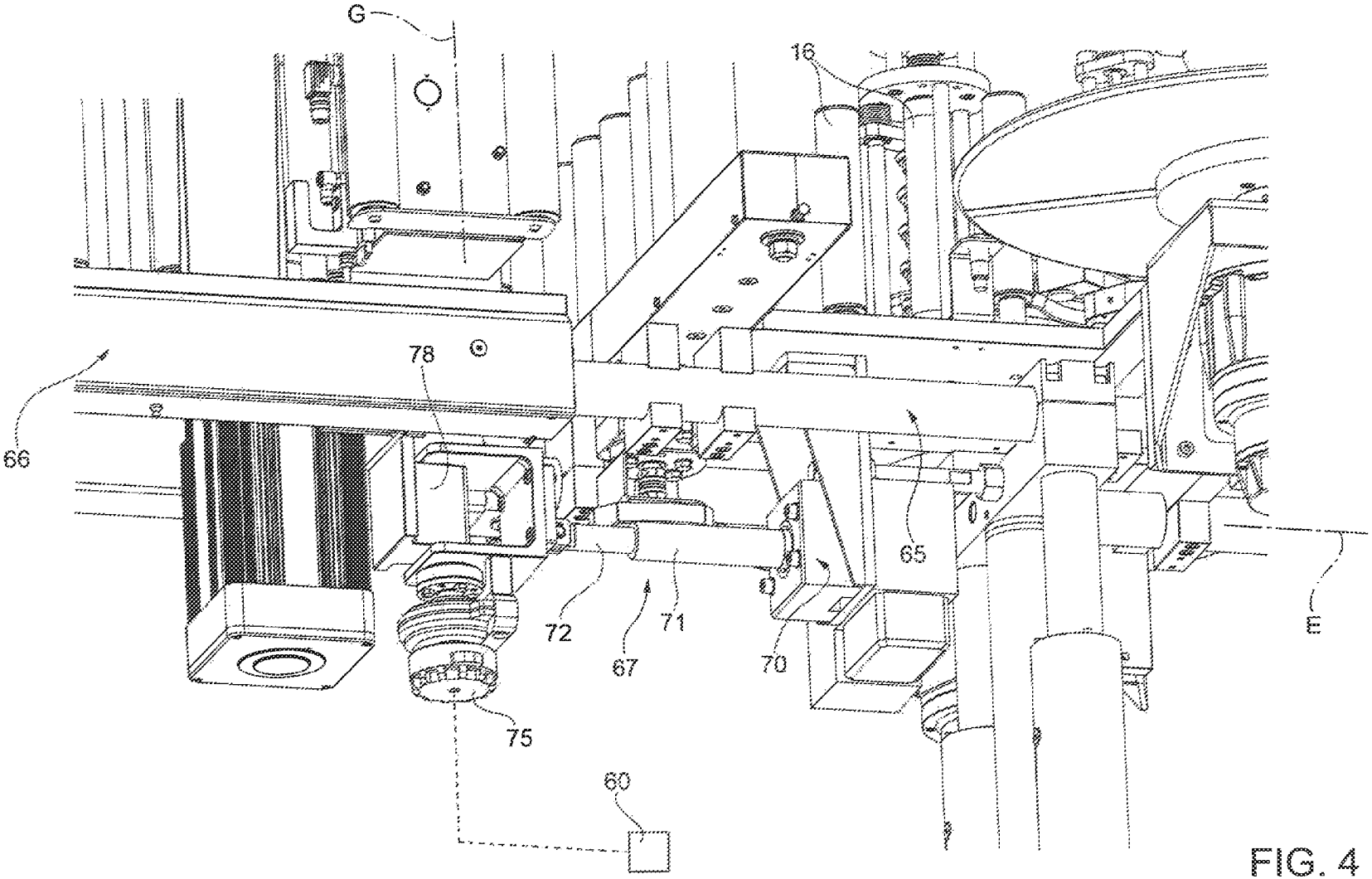
FIG. 4 is an enlarged perspective view of some components of the labelling group of FIGS. 2 and 3, with parts removed for clarity.
Figure 5:
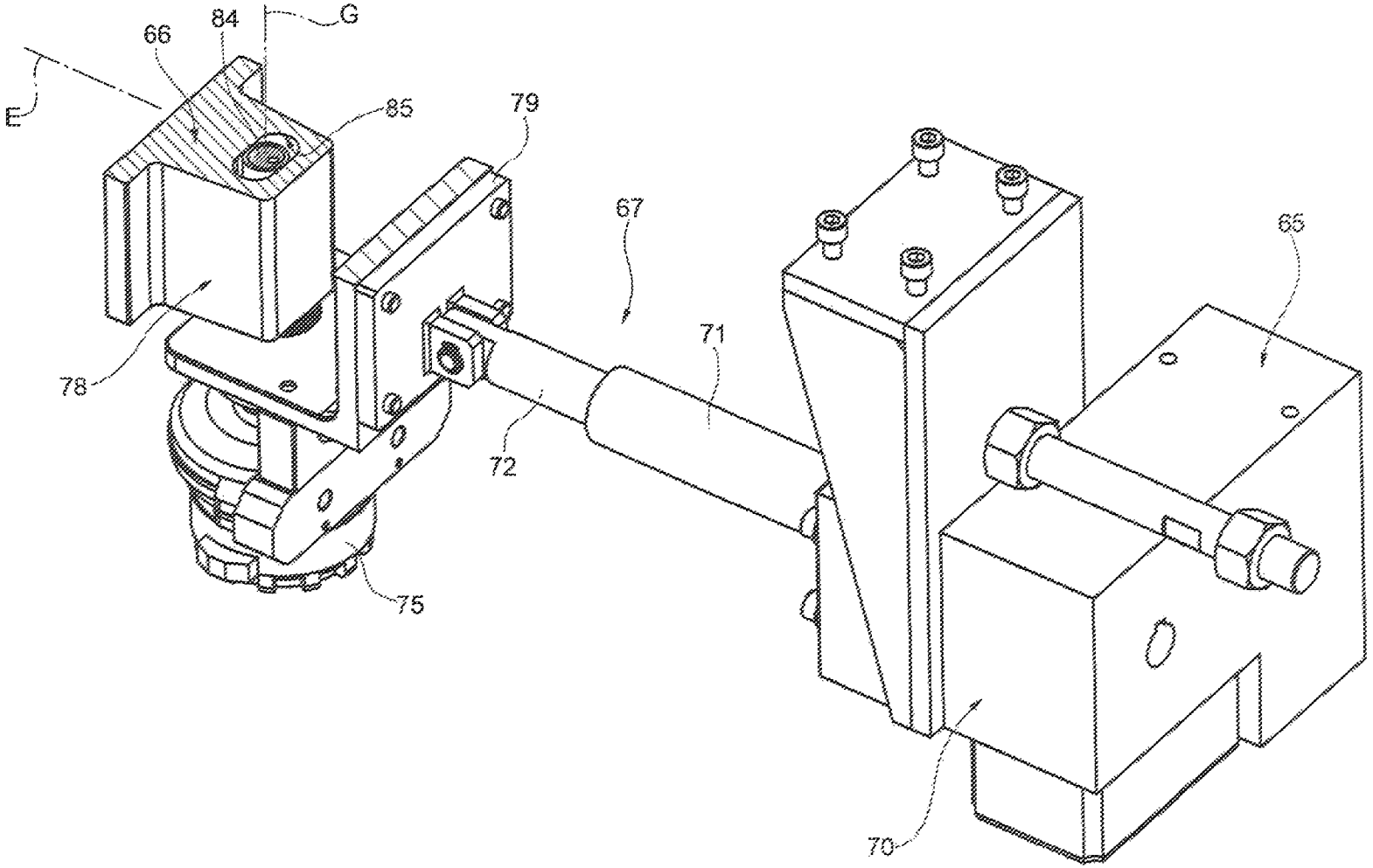
FIG. 5 is a further enlarged view of some components of the labelling group of FIGS. 2 to 4, with parts removed for clarity.

With reference to FIGS. 3 to 5, connecting means 67 comprise:

- a rotary actuator 70, which is supported by supporting structure 65;
- a shaft 71, which is driven in rotation by rotary actuator 70 about an its own axis parallel to direction E; and
- a rod 72, which is operatively connected to shaft 71.

Rod 72 and shaft 71 are operatively connected to each other, in such a way that the rotation of shaft 71 about an its own axis parallel to direction E causes the translation of rod 72 parallel to direction E.

In the embodiment shown, shaft 71 comprises, on the opposite side of rotary actuator 70, a portion with a female thread, which screws onto a male thread carried by a portion of rod 72. The male thread of rod 72 is, in particular, arranged on the side of rotary actuator 70.

Connecting means 67 further comprise:

- a motor 75 controlled by control unit 60, and connected to rod 72, by means of a C-shaped element 79;
- a shaft 76 which is driven in rotation by motor 75 about an axis G;
- an element 77 which rotates integrally with shaft 76 about axis G orthogonal to direction E; and
- a bracket 78, which is operatively connected to supporting structure 66, in particular to table 68.

Furthermore, bracket 78 and element 77 are coupled to each other, in such a way that the rotation of element 77 about axis G causes the sliding of bracket 78 parallel to direction E.

Still more precisely, element 77 comprises: a first portion 83 fitted to shaft 76 and a second portion 84 protruding from portion 83 parallel to and spaced from axis G.

Portion 83 is housed in a slot 85 (FIG. 5) defined by bracket 78. Slot 85 has a width parallel to direction E substantially corresponding to the width of portion 84, and a length in a direction orthogonal to direction E and axis G greater than the length of portion 84.

Accordingly, when element 77 rotates about axis G driven by motor 75, portion 84 eccentrically rotates about axis G inside slot 85, so causing the movement of bracket 78 and, therefore, of supporting structure 66 parallel to direction E.

Preferably, rotary actuator 70 is operated for arranging transfer element 13 in the operative position, on the basis of the format of articles 11, 11*a*, 11*b* while motor 75 is controlled by control unit 60 for displacing transfer element 13 between the operative position and the fully rest position.

Labelling unit 1 further comprises (FIGS. 15 to 17):

a sensor 80 for generating a signal associated to the fact one or more articles 11 need to be discarded from path P upstream of application station B, proceeding according to the advancing direction of articles 11, 11*a*, 11*b* along path P, so as to create a gap 82 inside the sequence of articles 11, 11*a*, 11*b* travelling along path P; and an expelling device 81 (only schematically shown in FIGS. 15 to 17) for expelling, in response to the signal generated by sensor 80, the aforementioned one or more articles 11, from path P upstream from application station B, proceeding according to the advancing direction of articles 11 along path P.

In particular, expelling device 81 is arranged upstream of station B.

Figure 15:
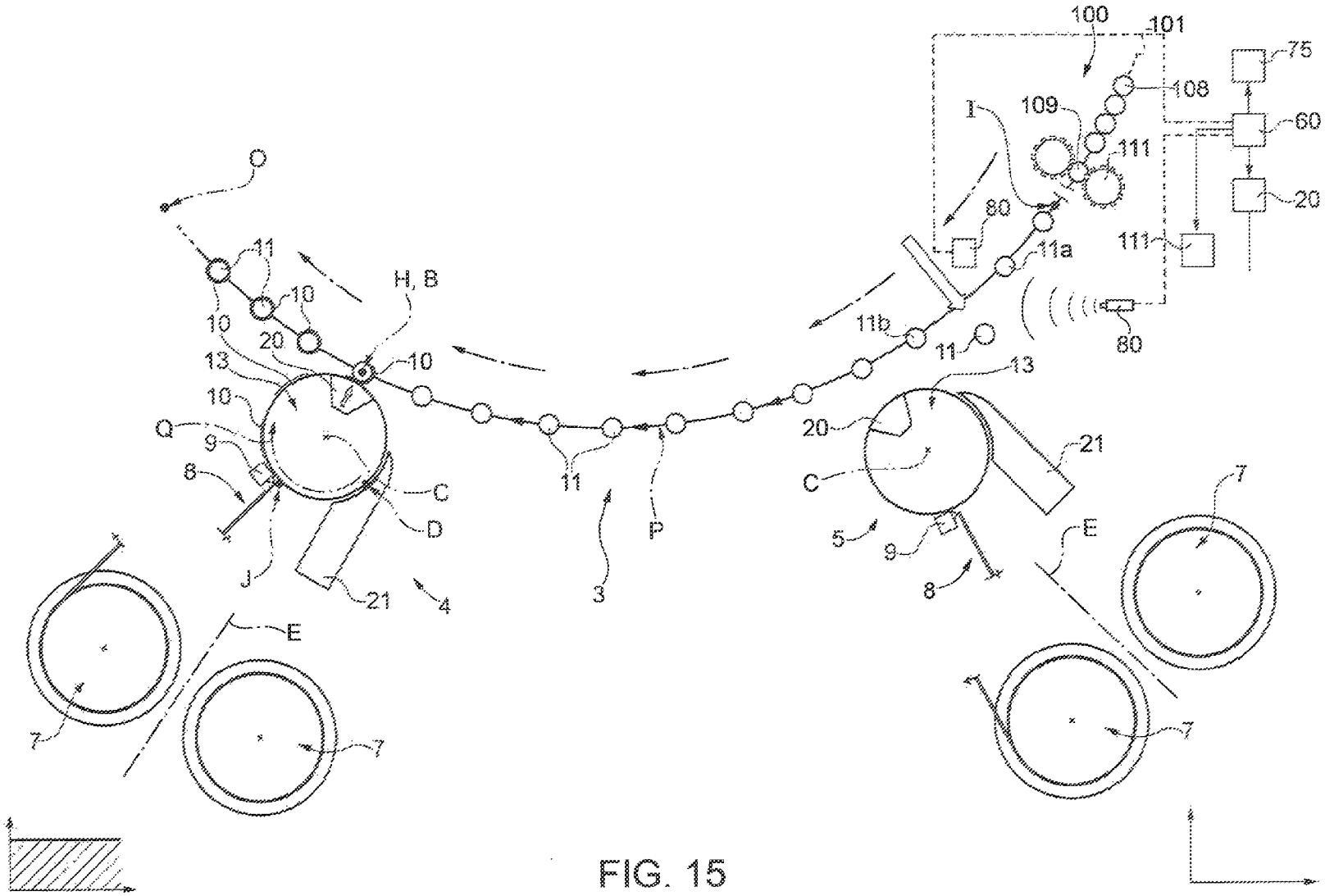
FIGS. 15 to 17 are schematic views of the labelling machine of FIG. 1 representing respective subsequent steps of a second operative scenario.
Figure 16:
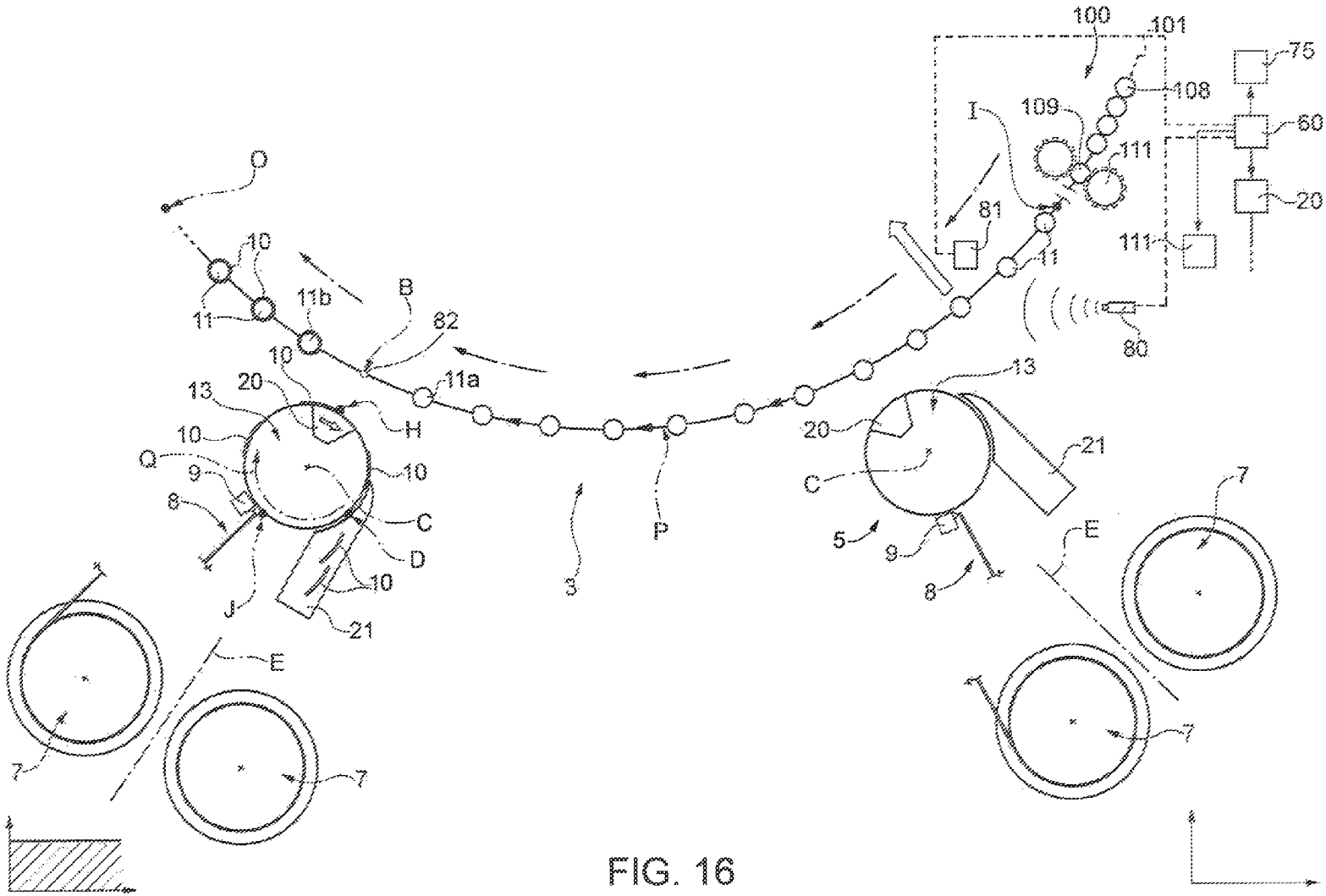
Figure 17:
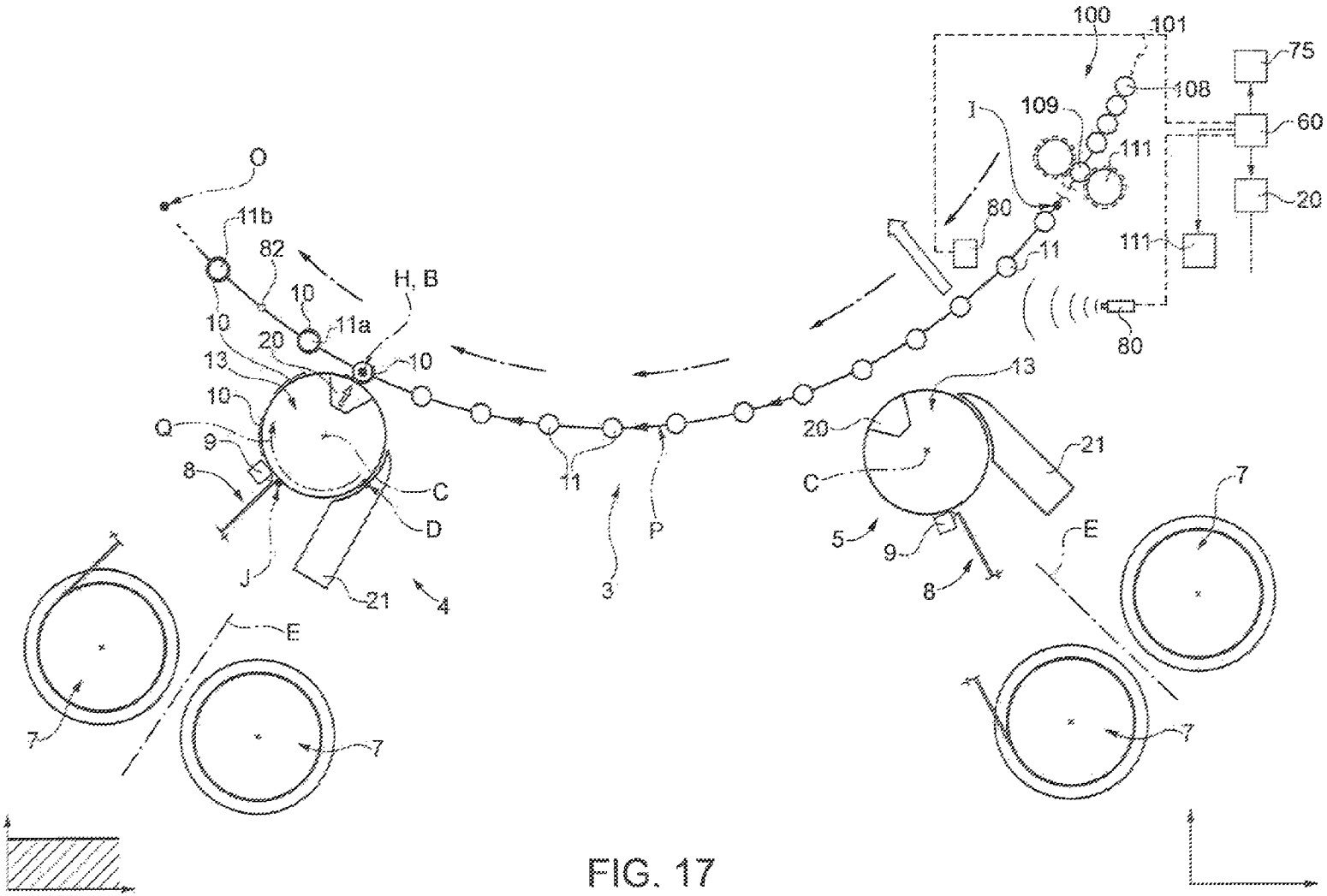

Gap 82 is delimited by an adjacent upstream article 11*a* and an immediately adjacent downstream article 11*b*, proceeding according to the advancing direction of articles 11, 11*a*, 11*b* along path P (FIGS. 15 to 17).

Control unit 60 is programmed for moving transfer element 13 from the operative position to the fully rest position and for displacing diverting device 20 from the first configuration to the second configuration, when the signal is generated by sensor 80 (FIG. 15).

Figure 18:
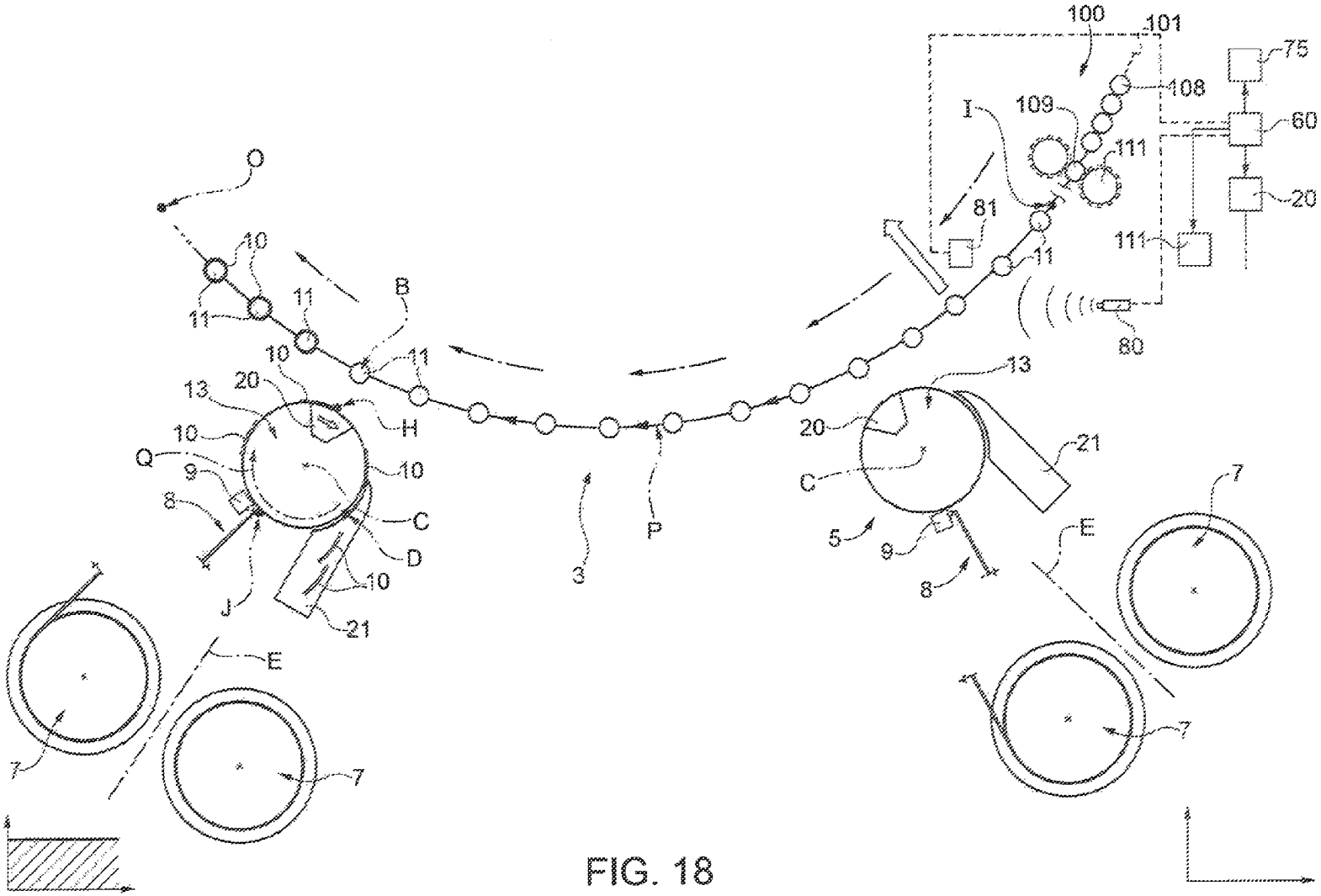
FIG. 18 is a schematic view of the labelling machine of FIG. 1 in a third operative scenario.

Preferably, control unit 60 is programmed for keeping the speed of transfer element 13 at a constant value, the highest value in the embodiment shown, when transfer element 13 moves from the operative position to the fully rest position and from the fully rest position to the operative position, as shown in the plot speed versus time in FIGS. 16 to 18.

Control unit 60 is also programmed, when the signal is generated by sensor 80, for moving transfer element 13 from the operative position to the fully rest position, after transfer element 13 has applied a label 10 onto immediately adjacent downstream article 11*b* (FIG. 16).

Furthermore, control unit 60 is programmed for moving back transfer element 13 from the fully rest position to the operative position, before immediately adjacent upstream article 11*a* has reached application station B (FIG. 17).

With reference to FIG. 18, control unit 60 is also programmed for moving transfer element 13 from the operative position to the fully rest position (or to one of the partly rest position), in case a not correct operation of labelling group 4 has been detected, without creation of any gap 82 between articles 11, 11*a*, 11*b* travelling at application station B.

The operation of labelling machine 1 and plant 100 is described in the following, starting from a condition in which labelling groups 4, 5 are in the respective fully rest positions.

Furthermore, the operation of labelling machine 1 and plant 100 is described starting from a condition in which labelling group 4 is operated to apply a plurality of labels 10 onto respective articles 11*a*, 11, 11*b* at station B of path P, while labelling group 5 is idle.

Accordingly, the rotational speed of drum 15 of labelling group 5 and, therefore, of strip 8 travelling inside labelling group 5 is null Conveyor 101 advances a plurality of pre-forms 108 through switch 101. Pre-forms 108 are blown in the blowing machine, so as to form respective articles 11, 11*a*, 11*b*. Articles 11, 11*a*, 11*b* are filled inside the filling machine and fed to carousel 3 of labelling machine 1.

Carousel 3 rotates about axis A and conveys a sequence of articles 11*a*, 11, 11*b* at substantially constant speed along path P from input station I to application station B and from application station B to output station O.

Furthermore, when labelling group 4 is in the fully rest position, respective diverting device 20 is in the second configuration, while transfer station H is coincident with application station B.

As shown in FIGS. 12 to 14, in order to start-up the labelling of articles 11, 11*a*, 11*b*, control units 60:

accelerates the rotational speed of drum 15 about axis C and, therefore, the linear speed of strip 8;

moves supporting structure 66 and, therefore, transfer element 13 along direction E, so as to move labelling group 4 from the fully rest position to the partly rest position and eventually to the operative position;

keeps diverting device 20 in the second configuration, when labelling group 4 is in the fully rest position and in the partly rest position, so as to convey labels 10 in the sucking device 21 at discarding station D; and displaces diverting device 20 in the first configuration, when labelling group 4 is in the operative position, so as to release labels 10 at transfer station H and apply those labels 10 onto articles 11, 11*a*, 11*b* at application station B coincident with transfer station H.

In particular, control unit 60 accelerates drum 15 according a liner ascending ramp up to the highest speed, which is reached before transfer element 13 reaches the operative position.

The operation of labelling machine 1 and plant 100 is now described with reference to only one label 10, to only one respective conveying section of transfer element 13 of labelling group 4 and to only one respective article 11, 11*a*, 11*b*.

Control unit 60 displaces labelling group 4 from the fully rest position to the operative position along direction E by activating motor 75.

In greater detail, the activation of motor 75 causes the rotation of shaft 76 and element 77 about same axis G.

Accordingly, portion 84 rotates eccentrically about axis G inside slot 85 of bracket 78, thus causing the displacement of bracket 78 along direction E with respect to supporting structure 65, and on the opposite side of supporting structure 65 and towards transfer station H.

As a result of the displacement of bracket 78 parallel to direction E, also table 68 and stator 14 of transfer element 13 moves along direction E and towards transfer station H.

At the same time, during the operation of labelling group 4, strip 8 is unwound off reel 7 and fed along path Q by the unwinding rollers.

Afterwards, cutting element 9 cuts, one after the other labels 10 from strip 8.

Drum 15 rotates about axis C so as to transfer along path Q, one after the other, cut label 10 from cutting element 9 to glue roller 12 whereat the glue is applied on cut label 10.

Still more precisely, each conveying section of drum 15 sucks relative label 10 at station J, conveys relative label 10 from station J to transfer station H and then from transfer station H to discarding station D.

In particular, air ports 17 of the upstream pad of each conveying section are fluidly connected with the vacuum source at station I, so as to suck the trailing edge of respective label 10.

As each conveying section rotates about axis C from station I to transfer station H, respective air ports 17 and air ports 17 of the downstream pad are connected to the vacuum source, so as to suck the remaining part of respective label 10.

Due to the fact that diverting device 20 is arranged in the second configuration, air ports 17 of each conveying section of drum 15 remain in fluidic connection with the vacuum source at transfer station H and do not eject any air nozzle onto relative label 10 at transfer station H, which is spaced from application station B.

As a matter of fact, electro-valve 35*a* is actuated so as to pump air in duct 46, thus arranging shutter 45 in the second position. Thus, stem 50 leaves free part of channel 30*a*, thus maintaining the fluidic connection between the vacuum source and channel 31*a* connected to air ports 17 travelling at transfer station H.

Furthermore, groove 55 of stem 50 is spaced from portions 54 of channels 51, 52 along axis F, thus fluidly isolating ducts 47, 48 and air ports 17 travelling at transfer station H.

In this way, labels 10 conveyed by drum 15 are not released at transfer station H but are discarded and sucked away by sucking device 21 at discarding station D.

When labelling group 4 has reached the operative position, path Q is tangent at application station B to the outer surface of articles 11*a*, 11*b*, 11*c* advanced by carousel 3. In other words, transfer station H and application station B coincide with one another.

At this stage, control unit 60 stops motor 75 and displaces diverting device 20 in the first configuration.

In particular, electro-valve 35*a* is de-activated, so that air is no longer pumped inside duct 46. Spring 58 can thus displace shutter 45 in the first position, in which it fully engages channel 30*a*. Accordingly, shutter 45 prevents the fluidic connection between the vacuum source and channel 31 connected to air ports 17 travelling at transfer station H coincident with application station B. Thus, no vacuum action is exerted on labels 10 at transfer station H coincident with application station B.

Furthermore, when shutter 45 is in the first position along axis F, groove 55 faces portions 54 of channels 51, 52, thus establishing a fluidic connection between ducts 47, 48 and air ports 17 travelling at station B, by means of superimposed channels 30*a*, 31*a*.

As a result, air ports 17 travelling at transfer station H—which coincides with application station B—eject a jet of air of label 10.

Thus, transfer element 13 applies label 10 on article 11, 11*a*, 11*b* travelling at application station B, thanks to the fact that the vacuum action is no longer exerted on label 10 travelling at station B and an air jet is ejected on that label 10.

With reference to FIGS. 15 to 17, in case it detects that one or more articles 11 travelling upstream of application station B must be discarded, sensor 80 generates a signal.

In response to that signal, expelling device 81 expels articles 11 to be discarded from path P, thus generating gap 82, which is bounded between upstream article 11*a* and downstream article 11*b*, proceeding according to the advancing direction of articles 11, 11*a*, 11*b* along path P.

Furthermore, control unit 60 moves transfer element 13 of labeling group from the operative position to the fully rest position, and displaces diverting device 20 in the second configuration, after transfer element 13 has applied label 10 onto downstream article 11*b* (FIG. 15).

In this way, label 10 is conveyed to sucking device 21 at discarding station D.

Still more precisely, control unit 60 keeps at the highest value the rotational speed of drum 15 and therefore of strip 8, when transfer element 13 moves from the operative position to the fully rest position.

Then, control unit 60 moves back transfer element 13 from the fully rest position to the operative position and displaces back diverting device 20 in the first configuration, before upstream article 11*a* has reached application station B (FIG. 16).

In this way, transfer element 13 apply labels 10 onto articles 11*a*, 11*b* and none of articles 11, 11*a*, 11*b* remains unlabelled.

When labelling of articles 11, 11*a*, 11*b*, has been completed, control unit 60 (FIGS. 19 to 21):

- slows down the rotational speed of drum 15 about axis C and, therefore, the linear speed of strip 8;
- moves supporting structure 66 and, therefore, transfer element 13 along direction E towards supporting structure 65, so as to move labelling group 4 from the operative position to the fully rest position; and
- displaces diverting device 20 in the second configuration, when labelling group 4 is in no longer in the operative position, so as to convey labels 10 to discarding station D, whereat they are sucked away by sucking device 21 (FIG. 20).

In particular, control unit 60 decelerates drum 15 according to a liner descending ramp up to null speed, which is reached in the fully rest position.

Furthermore, in case of not proper operation of labelling group 4, control unit 60 is programmed for moving transfer element 13 in the fully rest position or in the rest position (FIG. 18).

In this way, drum 15 does not contact articles 11, 11*a*, 11*b* travelling at application station B and there is no risk that drum 15 could dirty articles 11, 11*a*, 11*b* travelling at application station B.

From an analysis of the features of labelling group 4, 5 and method made according to the present invention, the advantages it allows to obtain are apparent.

In particular, transfer element 13 can be moved in the fully rest position or in the rest positions, in which trajectory Q of transfer element 13 is spaced from application station B.

In this way, when it is necessary, for several reasons, not to apply labels 10 onto articles 11, 11*a*, 11*b*, transfer element 13 can be retracted in the fully rest position or in one of the other partially rest positions, while diverting device 20 is set in the second configuration (FIG. 18).

In this condition, drum 15 does not contact articles 11, 11*a*, 11*b* travelling at station B.

There is no longer, therefore, the risk that drum can dirty articles 11, 11*a*, 11*b* travelling at station B, thus rendering the latter no longer usable.

Furthermore, during a start-up step of labelling group 4 (5) (FIGS. 12 to 14), control unit 60 is programmed for:

- moving transfer element 13 along direction E from the fully rest position to the operative position with diverting device 20 in the second configuration;
- displacing diverting device 20 in the first configuration, when transfer element 13 is in the operative position; and
- accelerating drum 15 and, therefore, strip 8 and labels 10, while transfer element 13 moves towards the operative position.

In this way, it is possible to accelerate drum 15 at a rotational speed about axis C higher than the rotational speed of drum of customary labelling group described in the introductory part of the present application.

As a result, it is possible to match drum 15 and, therefore, labelling groups 4, 5 with conveyor 3 advancing at very high speed, thus increasing the overall rate of labelling machine 1.

Furthermore, in case article 11 must be discharged upstream of application station B, expelling device 81 creates gap 82 upstream of application B and control unit 60 moves transfer element 13 in the fully rest position (or in one of the partially rest positions) while displaces diverting device 20 in the second configuration (FIGS. 16 and 17).

In this way, drum 15 does not apply labels 10 at application station B and conveys labels 10 to sucking device 21 at discarding station D.

Accordingly, transfer element 13 does not transfer any label 10 to transfer station H, when gap 82 passes through application station B.

Finally, control unit 60 is programmed for:

moving transfer element 13 in the fully rest position (or in one of the other rest positions) after transfer element 13 has applied label 10 onto downstream article 11*b* adjacent to gap 82; and moving back transfer element 13 in the operative position before upstream article 11*a* adjacent to gap 82 has reached application station B.

In this way, all articles 11*a*, 11*b*, adjacent to gap 82 are labelled by labelling group 4 (FIG. 17).

Finally, it is apparent that modifications and variants not departing from the scope of protection of the claims may be made to labelling group 4, 5 and to the method.

In particular, labelling group 4, 5 could comprise, instead of diverting device 20, a different device which can selectively deviate strip 8 from path Q upstream of cutting element 9.

In other words, that different device prevents strips 8 from reaching cutting element 9 and, therefore, drum 15.

Furthermore, control unit 60 could be programmed for advancing strip 8 and drum 15 of transfer element 13 according to different motion laws, when it moves transfer element 13 between the operative position and the fully rest position.

Finally, gap 82 could be created by controlling switch 111 , so as to interrupt the flow of pre-forms 108 upstream of labelling machine 1.

The invention claimed is:

1. A labelling group for applying at least one label onto a respective article at an application station, comprising:

a transfer element, which is adapted to transfer the label along a trajectory which comprises a transfer station, and can be arranged in an operative position, in which the transfer station coincides, in use, with the application station; and a diverting device, which can be selectively arranged in:

a first configuration, which allows the transfer element to convey the label along at least part of the trajectory and to release the label at the transfer station; or in a second configuration, which prevents the transfer element either from receiving the label or from releasing the label to the transfer station;

the transfer element being movable in at least one rest position, in which the trajectory is spaced from the application station.

2. The labelling group of claim 1, wherein the diverting device is arranged, in use, in the first configuration when the transfer element is arranged, in use, in the operative position; or the diverting device is arranged, in use, in the second configuration when the transfer element is arranged, in use, in the at least one rest position.

3. The labelling group of claim 1, further comprising:

a first supporting structure;

a second supporting structure, which supports the transfer element; and a connecting assembly interposed between the first supporting structure and the second supporting structure, and which are configured to allow the first supporting structure and the second supporting structure to move with respect to one another along a direction transversal to the trajectory, in order to render the transfer element movable with respect to the first supporting structure between the operative position and the at least one rest position.

4. The labelling group of claim 3, wherein the connecting assembly comprises:

a first motor carried by the first supporting structure;

a first element which is drivable in rotation by the first motor;

a second element, which is carried by the second supporting structure, is slidable along the direction, and is operatively connected to the first element to convert the rotation of the first element into the translation of the second element.

5. The labelling group of claim 4, wherein the connecting assembly further comprises:

a second motor, which is fitted to the first supporting structure;

a third element, which is drivable in rotation by the second motor about a first axis and comprises a portion eccentric with respect to the first axis; and a fourth element, which is connected to the second supporting structure, defines a slot engaged by the portion, and is coupled to the third element, such that the rotation of the element about the first axis causes the sliding of the fourth element along the direction.

6. The labelling group of claim 1, further comprising a control unit programmed for accelerating the speed of the transfer element when the transfer element moves, in use, from the at least one rest position to the operative position, and for decelerating the speed of transfer element when the transfer element moves, in use, from the operative configuration to the rest configuration.

7. The labelling group of claim 1, wherein the transfer element comprises:

at least one stationary vacuum source; and a drum rotatable about a second axis, and comprising a plurality of air ports selectively connectable with the vacuum source and which cooperate, in use, with the label to convey the label along the trajectory;

the air ports retaining, in use, the label on the drum, when fluidly connected, in use, to the vacuum source, and releasing the label when fluidly disconnected, in use, from the vacuum source; and at least one first duct, which is fluidly interposed between the vacuum source and the air ports;

the diverting device comprising:

a shutter arranged at the transfer station and which can be selectively set: either in a first position, which engages the first duct and interrupts the fluidic connection between the vacuum source and the air ports travelling, in use, at the transfer station; or in a second position, which leaves free, at least in part, the first duct and allows the fluidic connection between the vacuum source and the air ports travelling, in use, at the transfer station.

8. The labelling group of claim 7, further comprising at least one second duct, which is fluidly connectable to a source of a fluid in pressure;

the shutter fluidly connecting, in use, the second duct with the air ports travelling, in use, at the transfer station, when set in the first position to eject a jet of the fluid in pressure at the transfer station and to ease the release of the label;

the shutter fluidly disconnecting, in use, the second duct and the air ports travelling, in use, at transfer station, when set in the second position.

9. The labelling group of claim 8, wherein the shutter defines a fluidic line, which is fluidly connected with at least the second duct and the air ports travelling, in use, at the transfer station, when the shutter is in the first position;

the fluidic line being fluidly disconnected from the at least one second duct and the air ports travelling, in use, at the transfer station, when the shutter is in the second position.

10. The labelling group of claim 1, further comprising:

a shaft for advancing a strip of a plurality of labels connected to one another; and a cutting element for cutting the strip into a sequence of cut labels and feeding the transfer element with the sequence.

11. A labelling machine comprising:

a conveyor for conveying a succession of articles to be labelled along a conveying path and towards the application station; and at least one labelling group according to claim 1;

the conveyor being programmed to advance, in use, the articles tangentially to the trajectory at the application station, when the labelling group is in the operative position.

12. The labelling machine of claim 11, further comprising:

a sensor for generating a signal associated with at least one article of the sequence of the articles to be labelled being discharged; and an expelling device for expelling, in response to the signal, at least one immediately adjacent article from the conveyor upstream of the application station, proceeding along the conveying path according to an advancing direction of the articles, so as to create a gap inside the sequence of the articles; the gap being bounded by an adjacent upstream article of the articles and an immediately adjacent downstream article of the articles, proceeding according to the advancing direction of the articles along the path;

the control unit being programmed for moving the transfer element from the operative position to the at least one rest position, and from setting the diverting device in the second configuration, when the signal is, in use, generated.

13. The labelling machine of claim 12, wherein the control unit is programmed for moving the transfer element from the operative position to the at least one rest position, after the transfer element has applied, in use, a label onto the immediately adjacent downstream article;

the control unit being also programmed for moving back the transfer element from the at least one rest position to the operative position, before the immediately adjacent upstream article has reached the application station.

* * * * *